US009700775B2

(12) United States Patent
Hamilton et al.

(10) Patent No.: US 9,700,775 B2
(45) Date of Patent: Jul. 11, 2017

(54) SPORTS SWING TRAINER

(71) Applicants: Darryl Q. Hamilton, Houston, TX (US); Grant Schaffner, Independence, KY (US); John Kenneth De Witt, Houston, TX (US); Bradley Ruff, Bowling Green, OH (US)

(72) Inventors: Darryl Q. Hamilton, Houston, TX (US); Grant Schaffner, Independence, KY (US); John Kenneth De Witt, Houston, TX (US); Bradley Ruff, Bowling Green, OH (US)

( * ) Notice: Subject to any disclaimer, the term of this patent is extended or adjusted under 35 U.S.C. 154(b) by 0 days.

(21) Appl. No.: 14/568,536

(22) Filed: Dec. 12, 2014

(65) Prior Publication Data

US 2015/0165293 A1 Jun. 18, 2015

Related U.S. Application Data

(60) Provisional application No. 61/915,884, filed on Dec. 13, 2013.

(51) Int. Cl.

| | |
|---|---|
| ***A63B 69/00*** | (2006.01) |
| *A63B 71/06* | (2006.01) |
| *A63B 102/18* | (2015.01) |

(52) U.S. Cl.

CPC ..... *A63B 69/0002* (2013.01); *A63B 69/0059* (2013.01); *A63B 2069/0008* (2013.01); *A63B 2071/0655* (2013.01); *A63B 2102/182* (2015.10); *A63B 2225/09* (2013.01)

(58) Field of Classification Search

CPC . A63B 69/0059; A63B 69/0002; A63B 69/38; A63B 69/3608; A63B 69/0071; A63B 2069/0008; A63B 2071/0655; A63B 2225/09

USPC ..... 473/422, 450, 458, 464, 453, 276, 275, 473/212–214

See application file for complete search history.

(56) References Cited

U.S. PATENT DOCUMENTS 3,339,926 A * 9/1967 Coupar ..... A63B 69/0059 473/214
3,419,277 A * 12/1968 Martin ..... A63B 69/0059 473/214
3,937,465 A * 2/1976 Roland ..... A63B 69/38 473/229

(Continued)

*Primary Examiner* — Mitra Aryanpour

(74) *Attorney, Agent, or Firm* — Wood Herron & Evans LLP

(57) ABSTRACT

A sports swing trainer includes a gripping portion configured to enable a user to grasp the trainer while in a batting stance, an arm positioning portion, and an alignment portion connecting the other two portions together. The arm positioning portion includes parts that simultaneously engage with a top of the shoulder and a brachium of the user when in a proper batting stance, and the arm positioning portion provides tactile feedback reminding the user to begin a swinging motion with hip and leg movements rather than arm movements. The alignment portion may include one or more joints that enable custom positioning of the gripping portion and the arm positioning portion to suit the training needs of many different users. The sports swing trainer provides an easy to manufacture solution for baseball/softball bat swing training which focuses on the mechanics of the swing rather than ball placement and contact.

15 Claims, 19 Drawing Sheets

(56) References Cited

U.S. PATENT DOCUMENTS 4,582,325 A * 4/1986 Yuhara ..... A63B 69/3608 434/252
4,746,118 A * 5/1988 Deveney ..... A63B 69/0059 473/458
4,984,789 A * 1/1991 Socci ..... A63B 69/0059 473/458
5,150,901 A * 9/1992 Stawicki ..... A63B 69/365 473/215
5,154,416 A * 10/1992 Smull ..... A63B 69/0059 473/213
5,441,271 A * 8/1995 Briggs ..... A63B 69/3608 473/215
5,520,392 A * 5/1996 Foresi ..... A63B 69/0059 473/227
5,544,886 A * 8/1996 VanSkiver ..... A63B 69/0059 473/143
5,954,598 A * 9/1999 Carlson ..... A63B 69/0059 473/458
6,358,156 B1 * 3/2002 Moran ..... A63B 69/3632 473/212
6,471,598 B2 * 10/2002 Takase ..... A63B 69/0059 473/207
6,800,036 B2 * 10/2004 Rohan-Weaver .. A63B 69/0059 473/219
6,827,654 B2 * 12/2004 Meyer ..... A63B 69/0059 473/207
7,128,658 B2 * 10/2006 DuFour ..... A63B 69/3608 473/207
7,547,256 B1 * 6/2009 Petrie ..... A63B 69/0059 473/207
8,852,015 B1 * 10/2014 Hoang ..... A63B 69/3608 473/212
9,295,868 B2 * 3/2016 Beroza ..... A63B 21/0442 473/458
9,440,131 B2 * 9/2016 Mueller ..... A63B 69/0002 473/458
9,592,435 B1 * 3/2017 Faucette ..... A63B 69/3608 473/215
2002/0039930 A1 * 4/2002 Smith ..... A63B 69/0059 473/215
2007/0243956 A1 * 10/2007 Harris ..... A63B 69/0059 473/458
2015/0165293 A1 * 6/2015 Hamilton ..... A63B 69/0002 473/453

* cited by examiner

SPORTS SWING TRAINER

CROSS-REFERENCE TO RELATED APPLICATION

This application claims the benefit of U.S. Patent Application Ser. No. 61/915,884, filed on Dec. 13, 2013, the disclosure of which is incorporated by reference herein in its entirety.

TECHNICAL FIELD

The present invention generally relates to sports training equipment and methods, and more particularly, relates to a sports swing trainer and method designed to improve and make more consistent a user's swing of a baseball or softball bat.

BACKGROUND

A need exists for an easily produced, inexpensive, but highly durable baseball swing training device that provides attention to hand placement on a baseball bat and improves the athlete's hip motion and builds up muscle strength in the hips. Although reference is made throughout this document to training for baseball and swinging a baseball bat, it will be appreciated that the same concepts apply equally and can be used for softball players learning to swing a softball bat (and furthermore, it is deemed that a softball bat and a baseball bat are the same item in accordance with this disclosure).

There are at least some conventional sports swing trainers available on the market for teaching a user how to properly swing a piece of sports equipment, such as a golf club. For example, a golf swing position trainer is described in U.S. Pat. No. 6,800,036. This position trainer helps a golfer become more consistent and proper in form when performing backswings in the game of golf. Although such a position trainer is helpful for users who want to become better at the sport of golf, this trainer is not helpful when trying to teach similar concepts for the sport of baseball. A proper baseball swing requires detailed attention to hand placement on the baseball bat, the initial positioning of the bat relative to the user's body, as well as a swinging motion driven initially by the user's hips instead of the arms, which is contrary to the largely wrist and arm-driven initial motion of a golf backswing.

In addition, the golf swing position trainer of the patent referenced above must be manufactured and specifically tailored to a particular user because the rigid shape and size of this trainer will not work for users having different body sizes and proportions. This custom tailoring and manufacturing increases the cost of the device to a level that is not acceptable for many consumers who play these sports as a side hobby or activity. Furthermore, even when considering baseball training devices and aids, many of the products available on the market focus more on providing a consistent target to hit for a baseball player than improving the actual mechanics of the swing itself.

Therefore, it would be desirable to provide a device for training a user how to swing a baseball bat that is easily manufactured and inexpensive, while also being simple to use and adjustable so that multiple users can learn to swing a baseball bat with a single device. The embodiments of the invention described below are considered to meet these needs in the marketplace.

SUMMARY

In accordance with one embodiment of this disclosure, a sports swing trainer is configured to train a user to properly position and swing a baseball bat. The trainer includes a gripping portion, an arm positioning portion, and an alignment portion. The gripping portion is configured to enable a user to grasp the trainer with hands in such a manner similar to grips used to hold a baseball bat. The arm positioning portion sized to simultaneously engage a top portion of a shoulder of the user and also engage a brachium defined by the arm of the user connected to the shoulder. The alignment portion extends between and connects the gripping portion to the arm positioning portion. The alignment portion includes at least one joint that is configured to adjust relative positions of the gripping portion and the arm positioning portion. When the gripping portion is held by the hands of the user and the user assumes a batting stance, a first part of the arm positioning portion engages the top portion of the shoulder while a second part of the arm positioning portion engages the brachium of the user. This allows for tactile feedback regarding an appropriate starting position for a swing as well as a tactile reminder to start a swinging motion with hip and leg movement rather than arm movements.

In one aspect, the arm positioning portion further includes a harness member defining the first and second parts of the arm positioning portion. The harness member is sized to wrap around the shoulder of the user when the first part of the arm positioning portion engages the top portion of the shoulder and the second part of the arm positioning portion engages the brachium. The harness member is therefore tailored to the body of the user at this location around the shoulder.

In another aspect, the at least one joint includes a telescoping joint and/or a rotating joint. The telescoping joint is operable to extend or retract parts of the alignment portion relative to one another or relative to the gripping portion or the arm positioning portion. It will be understood that the telescoping joints described herein also enable relative rotation of the connected elements, with the rotation being around the longitudinal axes of the connected elements. The rotating joint is operable to modify an angle defined between parts of the alignment portion. In some embodiments, the alignment portion includes both telescoping joints and rotating joints. Moreover, each telescoping joint and rotating joint may include a threaded fastener and nut that are manually tightened to lock the corresponding joint in position and manually loosened to adjust the corresponding joint. This tightening, loosening, and adjusting can be done with one hand, for example.

In yet another aspect, the gripping portion of the trainer includes a bat-like handle connected to the alignment portion. The bat-like handle has an elongated handle shaft and an enlarged knob at a terminal end of the handle shaft opposite the alignment portion. The gripping portion further comprises a grip sleeve surrounding the handle shaft in some embodiments, the grip sleeve enhancing the user's grasp of the gripping portion with hands. The grip sleeve may be removable or integrally formed with the handle. The grip sleeve may include a pattern formed in an exterior surface which is configured to train a user to visually inspect and verify a proper grip of the gripping portion with the hands. Alternatively, the grip sleeve can include an exterior surface having outwardly projecting ridges configured to properly align the hands of the user when grasping the gripping portion.

Instead of including a bat-like handle at the gripping portion, the trainer in other embodiments includes a gripping portion with a retention clip device configured to snap into frictional engagement with a conventional separate baseball bat. In such embodiments, the user holds the baseball bat as normal with the hands while the baseball bat is engaged with the retention clip device, thereby positioning the trainer accordingly. The retention clip device includes at least two pairs of resilient spring arms which snap into engagement with the baseball bat to prevent sliding movement of the baseball bat relative to the gripping portion. Of course, it will be appreciated that each of the features described above may be combined in any subcombination of features for the trainer.

In a further aspect, the arm positioning portion and at least a part of the alignment portion are collectively defined by a unitary rod member having a series of straight portions and curved portions. For example, the alignment portion may include a first straight portion connected to the joint and a first curved portion extending from the first straight portion opposite the joint. The arm positioning portion then includes the following elements, in series extending from the first curved portion: a second straight portion, a second curved portion, a third straight portion, a third curved portion, a fourth straight portion, a fourth curved portion, a fifth straight portion, and a curved hook at the terminal end thereof. The second straight portion defines the first part of the arm positioning portion which engages the top portion of the shoulder of the user, and the curved hook defines the second part of the arm positioning portion which engages the brachium of the user. In some embodiments, the joint may include a ratcheting joint with a receptacle designed to receive the first straight portion of the unitary rod member. Likewise, a second receptacle at the ratcheting joint can receive a connection rod extending from the gripping portion.

In another embodiment in accordance with this disclosure, a method for training a user to properly position and swing a baseball bat by using a sports swing trainer is provided. The sports swing trainer includes a gripping portion, an arm positioning portion, and an alignment portion with at least one joint which connects the gripping portion to the arm positioning portion. The method includes positioning a user in a batting stance such that the user holds the sports swing trainer with hands at the gripping portion. The arms of the user are properly aligned while in the batting stance by positioning the sports swing trainer such that a first part of the arm positioning portion engages a top portion of a shoulder of the user and such that a second part of the arm positioning portion simultaneously engages a brachium of the user. The method further includes providing tactile feedback with the arm positioning portion to help the user start a swinging motion with hip movements instead of with arm movements that would cause the arm positioning portion to come out of engagement with at least one of the top portion of the shoulder and the brachium. In some embodiments, the method also includes adjusting relative positions of the gripping portion and the arm positioning portion by adjusting the at least one joint.

BRIEF DESCRIPTION OF THE DRAWINGS

The accompanying drawings, which are incorporated in and constitute a part of this specification, illustrate embodiments of the invention and, together with a general description of the aspects given above, and the detailed description of the embodiments given below, serve to explain the principles of the invention.

Figure 1:
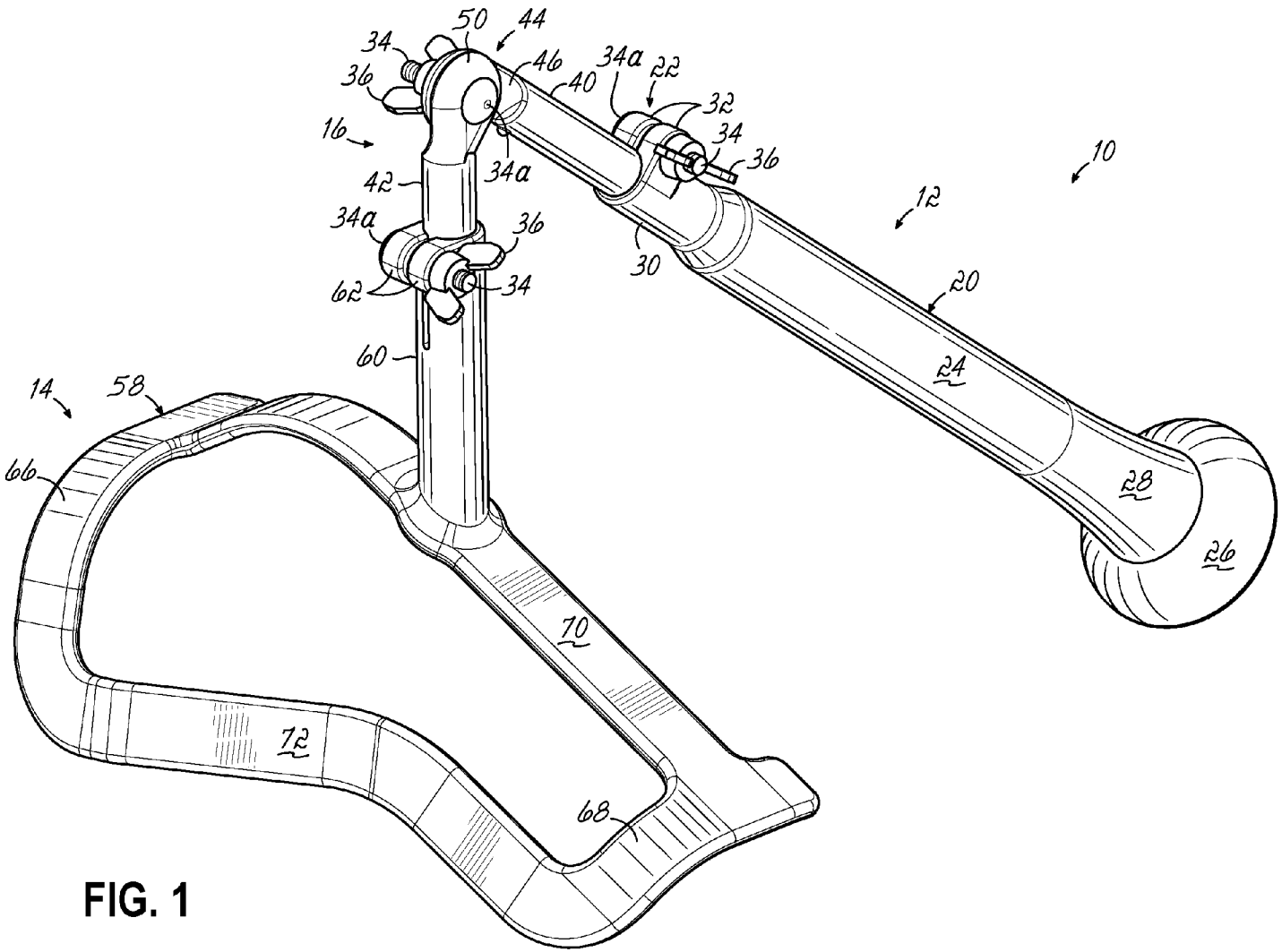
FIG. 1 is a front perspective view of a sports swing trainer in accordance with one exemplary embodiment of the present invention, the trainer being used to help a user learn how to properly position in a batting stance and then swing a baseball bat.

The present embodiments are detailed below with reference to the listed Figures.

DETAILED DESCRIPTION

Before explaining the embodiments of the sports swing trainer and associated methods of use in detail, it is to be understood that this apparatus and method are not limited to the particular embodiments, which can be practiced or carried out in various ways. For example, several specific variations and alternatives are also described in connection with the embodiments set forth below.

With reference to FIGS. 1 through 7, a first exemplary embodiment of a sports swing trainer 10 configured to train a user on how to swing a baseball bat is shown. The sports swing trainer 10, also referred to as "trainer" 10 in this disclosure, includes a number of portions which interact with different body parts of a user learning how to properly begin swinging a baseball bat. The swing of a baseball bat begins from what is called a batting stance, in which the user holds a bat with hands so that it extends upwardly around a rear shoulder while standing with a shoulder-width or wider separation of the feet. Many swing mistakes begin right at this batting stance and at the start of a swing because users do not accurately position the arms in the batting stance, or the swing is started with arm movements instead of hip and leg movements. Therefore, by placing a gripping portion 12 of the trainer 10 in the user's hands and then placing an arm positioning portion 14 of the trainer 10 on the shoulder and arm of a user (described in further detail below with reference to FIG. 7), the user is provided with tactile feedback on a proper initial positioning of the hands and arms, which should be largely maintained during the initial part of a swinging motion when the hips and back leg begin to drive the body motion. The gripping portion 12 and the arm positioning portion 14 are joined together by an alignment portion 16 which is set to align the other two portions 12, 14 in proper relative position to one another. The sports swing trainer 10 is therefore inexpensive to manufacture, simple to use, and easy to adjust when necessary, while also providing the specific specialized type of feedback at the beginning of a baseball bat swing which is not addressed by conventional training devices (many of which focus on other types of more arm-based swings like golf club swings).

Figure 2:
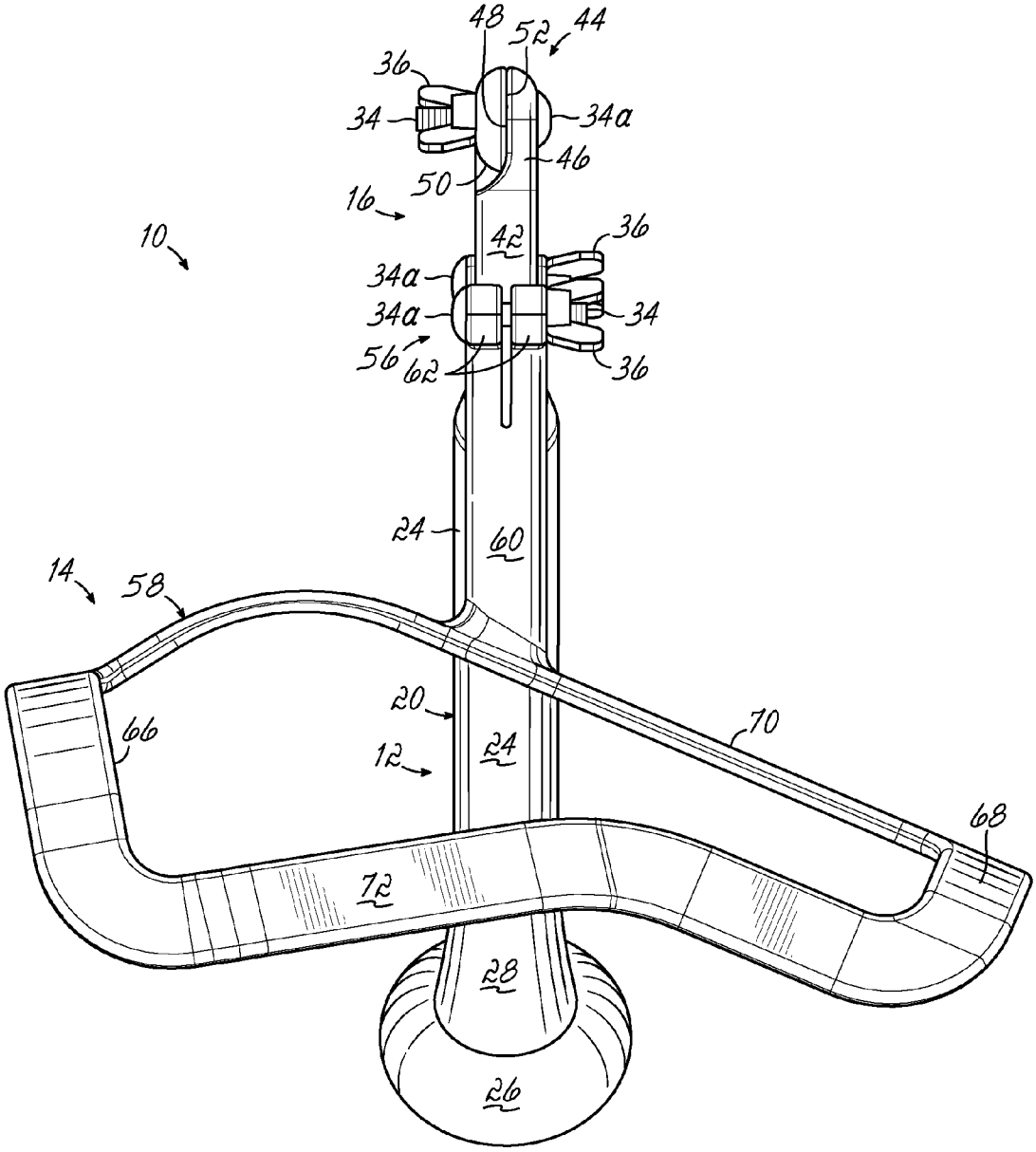
FIG. 2 is a front view of the sports swing trainer of FIG. 1, showing further profile features of a harness member at one end of the trainer.
Figure 3:
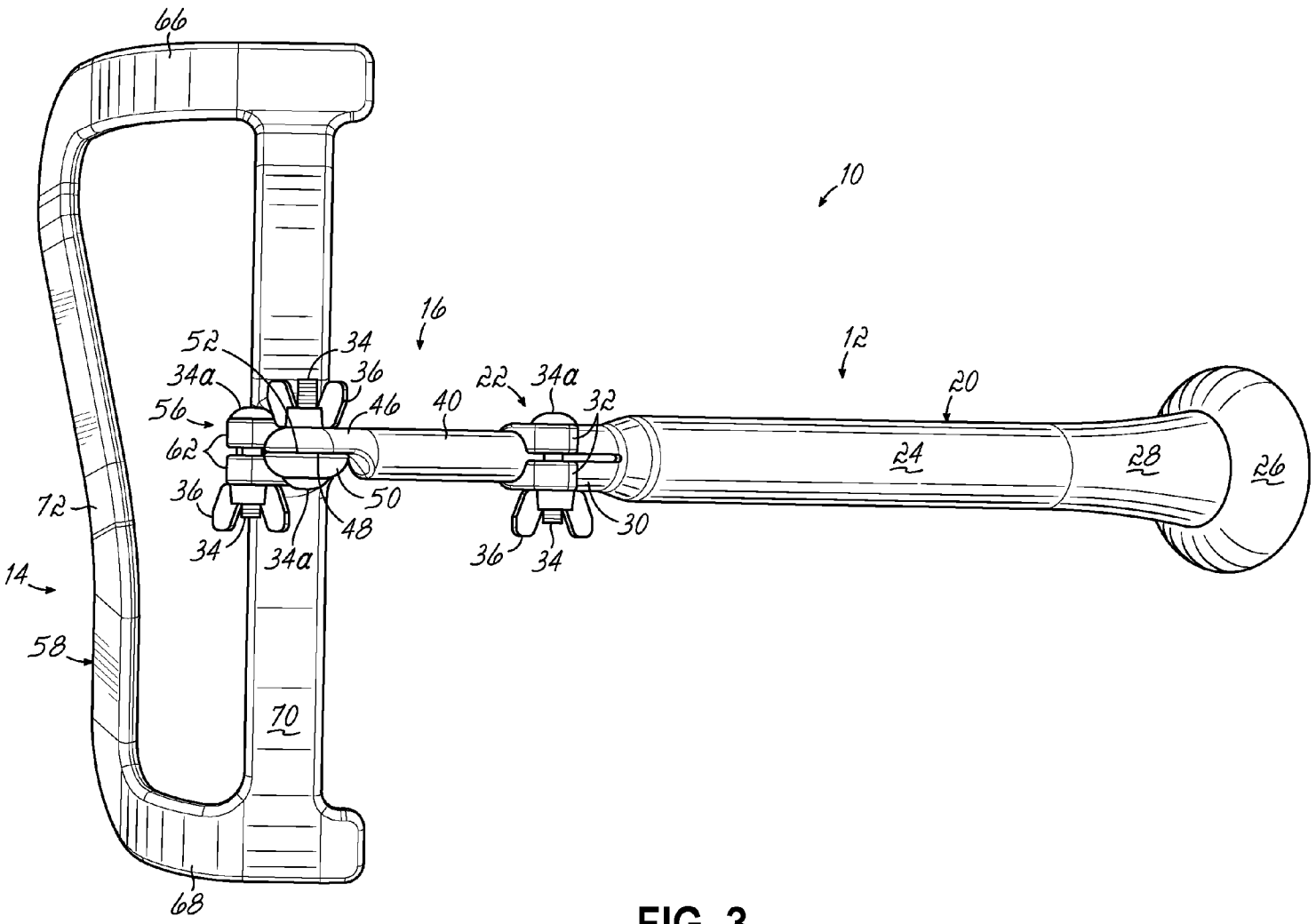
FIG. 3 is a rear view of the sports swing trainer of FIG. 1, showing further details of the gripping portion of the trainer.

With continued reference to FIGS. 1 through 3, the trainer 10 is shown from various angles to elucidate the various features and components. To this end, the gripping portion 12 of this embodiment includes a bat-like handle 20 that is connected to the alignment portion 16 at a first telescoping joint 22. The bat-like handle 20 is designed to simulate the portion of a conventional baseball bat that would be grasped by a user's hands while swinging the bat. Accordingly, the bat-like handle 20 includes an elongated handle shaft 24 leading to an enlarged knob 26 at a terminal end away from the connection to the alignment portion 16. The handle shaft 24 and the knob 26 collectively appear to be a truncated baseball bat, which will be a natural place for a user to grip and hold the trainer 10. It will be understood that the handle shaft 24 and the knob 26 are typically formed by injection molded of a plastic material such as polypropylene, polyethylene, polyethylene terephthalate, synthetic rubber, and combinations thereof, although these elements may also be formed from wood, metals such as aluminum, and fiber composite materials in other embodiments within the scope of this disclosure.

Though not shown in the specific illustration of the FIGS. 1 through 7 embodiment of the trainer 10, the handle shaft 24 may be configured to receive a removable grip sleeve so as to enhance the ability of a user to properly grasp the gripping portion 12 with the hands. Two specific types of grip sleeves are explained in further detail for other embodiments below, but it will be appreciated that these and other similar types of grip sleeves can be installed on this first exemplary embodiment or any other embodiment of the trainer 10.

The handle shaft 24 of the bat-like handle 20 is largely cylindrical in shape along most, if not all, of the length thereof. This handle shaft 24 typically has a diameter of about 1.0 to 2.0 inches along this cylindrical-like portion. As shown in FIG. 1, the handle shaft 24 may also be slightly tapered along a tapered portion 28 thereof, which is located adjacent to the knob 26. The knob 26 is relatively donut-shaped and expands outwardly from the handle shaft 24 so as to define a larger diameter of about 1.5 to 3.0 inches, for example. Much like in a conventional baseball bat, the knob 26 provides visual guidance for where to place the hands on the handle shaft 24 while also prevent slippage of the gripping portion 12 from the hands during swing training movements.

On an opposite end of the handle shaft 24 from the knob 26, the gripping portion 12 further includes a narrowed-diameter hollow receptacle 30 configured to form a first portion of the first telescoping joint 22. The hollow receptacle 30 includes a narrowed diameter so as to be slightly larger in size than the rod-like members defining the alignment portion 16 as described in further detail below, although it will be understood that the relative size of this receptacle 30 compared to the handle shaft 24 can be varied in other embodiments depending on changes in the alignment portion 16. The hollow receptacle 30 is formed as a split ring with two outwardly projecting flanges 32 formed near a terminal end thereof on opposite sides of the split. The first telescoping joint 22 further includes a manually-adjustable securing assembly, which in this embodiment takes the form of a threaded bolt 34 and a wing nut 36 threadably engaged with the bolt 34. The bolt 34 extends through apertures (not shown) in the flanges 32 with a head 34*a* of the bolt on one side opposite the side where the wing nut 36 engages the bolt 34. Thus, as the wing nut 36 is tightened on the bolt 34, these elements draw the flanges 32 of the split ring shape of the receptacle 30 closer together to thereby compress the space therein and clamp onto the part of the alignment portion 16 inserted into the receptacle 30. The first telescoping joint 22 is therefore manually tightened to lock these elements in relative position and manually loosened when adjustment is necessary. It will be understood that other types of securing assemblies and fasteners/nuts may be used in other embodiments of the trainer 10 at this first telescoping joint 22. Furthermore, in this and other telescoping joints throughout this disclosure, the two elements being connected can also be rotated relative to one another about the longitudinal axes of the elements (e.g., for the first telescoping joint 22, the first elongate rod 40 described below may be rotated as well as moved laterally relative to the hollow receptacle 30 when the first telescoping joint 22 is loosened).

The alignment portion 16 of this embodiment of the trainer 10 is largely defined by a first elongate rod 40 and a second elongate rod 42 coupled to one another at a first rotating joint 44. Similar to the gripping portion 12, the first and second elongate rods 40, 42 are typically formed by injection molded of a plastic material such as polypropylene, polyethylene, polyethylene terephthalate, synthetic rubber, and combinations thereof, although these elements may also be formed from wood, metals such as aluminum, and fiber composite materials in other embodiments within the scope of this disclosure. The first elongate rod 40 is cylindrical along most of the length thereof so that the first elongate rod 40 can be slid within and clamped in position within the split ring defined by hollow receptacle 30 on the gripping portion 12. The first elongate rod 40 includes a narrowed or scalloped end portion 46 that includes an aperture (not shown) for a bolt 34 and a generally planar joint surface 48 configured to abut a similar surface on the second elongate rod 42. This scalloped end portion 46 and the engagement with the second elongate rod 42 at the first rotating joint 44 is shown in more detail in FIGS. 2 and 3.

Similarly, the second elongate rod 42 is cylindrical along most of the length thereof so that the second elongate rod 42 can be slid within and clamped in position within a split ring defined by a hollow receptacle on the arm positioning portion 14 (described in further detail below). The second elongate rod 42 includes a narrowed or scalloped end portion 50 that includes an aperture (not shown) for the bolt 34 and a generally planar joint surface 52 configured to abut the generally planar joint surface 48 on the first elongate rod 40 as shown in the assembled state in the Figures. The scalloped end portions 46, 50 of the first and second elongate rods 40, 42 enable the first and second elongate rods 40, 42 to be rotated relative to one another at the generally planar joint surfaces 48, 52 when the first rotating joint 44 is loosened. Although the first and second elongate rods 40, 42 are shown as completely separate elements in this embodiment, it will be understood that these could be replaced with a two-part joint member such as described in connection with alternative embodiments of the trainer described below.

The first rotating joint 44 is defined by the scalloped end portions 46, 50 of the first and second elongate rods 40, 42 in combination with a threaded bolt 34 and wing nut 36. To this end, the first rotating joint 44 is similarly manually adjustable and fixable using the same type of threaded bolt 34 and wing nut 36 that are also used in conjunction with the first telescoping joint 22. The bolt 34 extends through the apertures (not shown) in the scalloped end portions 46, 50 with a head 34*a* of the bolt on one side opposite the side where the wing nut 36 engages the bolt 34. Thus, as the wing nut 36 is tightened on the bolt 34, these elements draw the planar joint surfaces 48, 52 closer together to frictionally prevent further relative rotation of the first and second elongate rods 40, 42. The first rotating joint 44 is therefore manually tightened to lock these elements in relative position and manually loosened when adjustment is necessary. As with the first telescoping joint 22, it will be understood that other types of securing assemblies and fasteners/nuts may be used in other embodiments of the trainer 10 at this first rotating joint 44.

Figure 5:
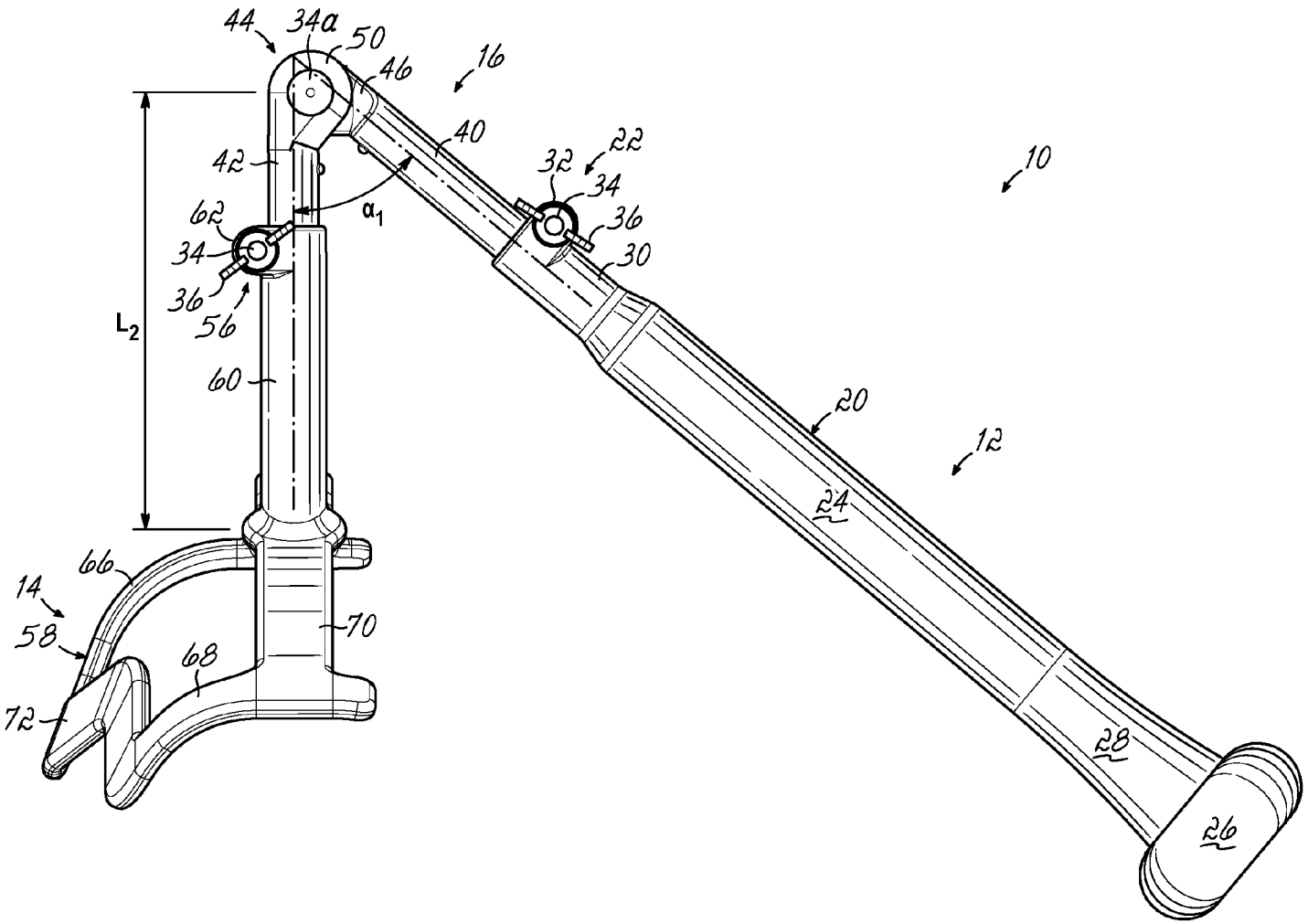
FIG. 5 is a side view of the sports swing trainer similar to FIG. 4, with the telescoping joint of the trainer adjusted to a different position.
Figure 6:
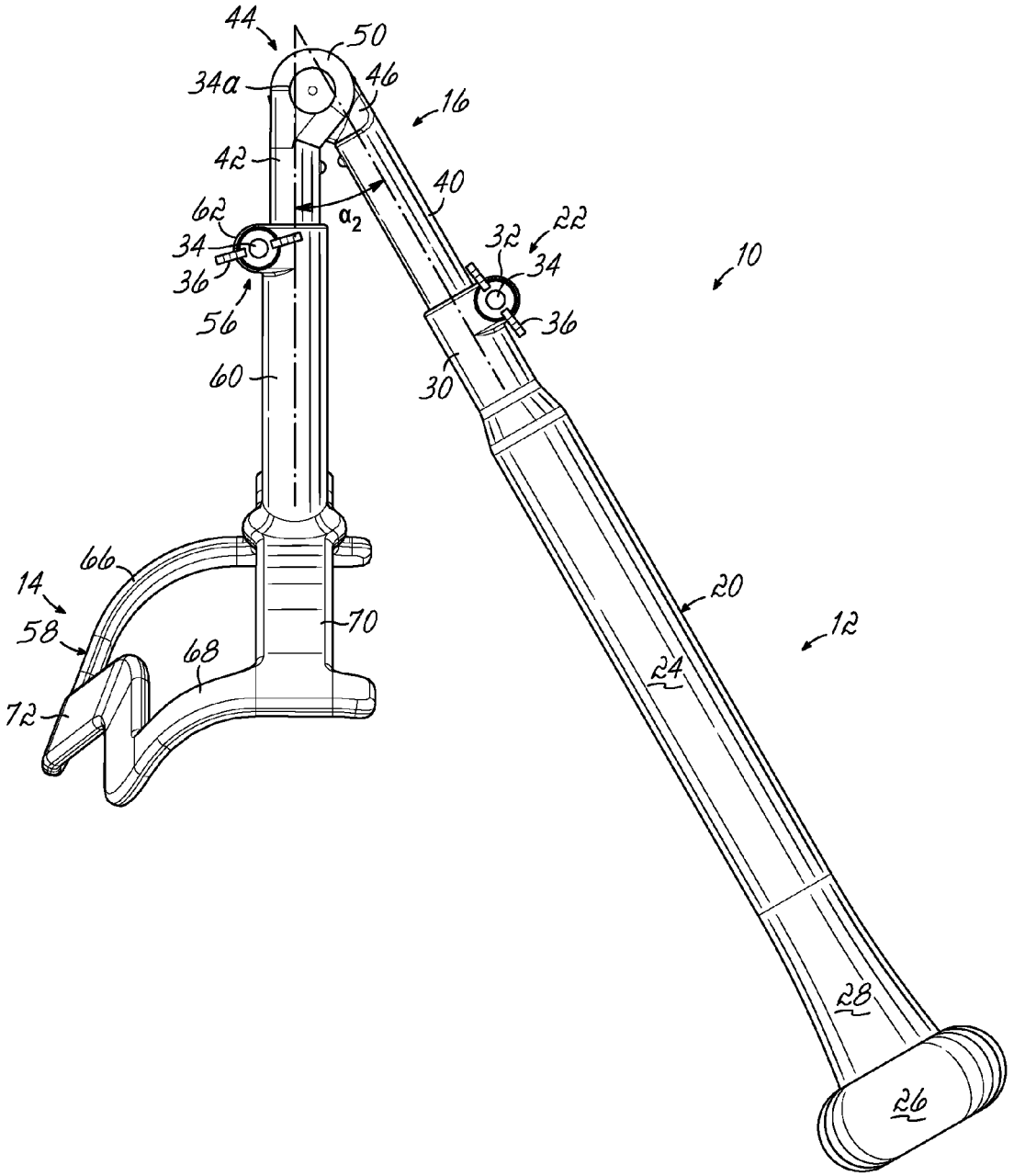
FIG. 6 is a side view of the sports swing trainer similar to FIG. 4, with the rotating joint of the trainer adjusted to a different position.

The operation of the first rotating joint 44 at the alignment portion 16 is shown most clearly in FIGS. 5 and 6. In FIG. 5, the first and second elongate rods 40, 42 are in a first position defining an acute angle $\alpha_1$ between their corresponding central axes as shown. By contrast, FIG. 6 illustrates that after loosening and adjustment at the first rotating joint 44, the first and second elongate rods 40, 42 are in a second position defining a smaller acute angle $\alpha_2$ between their corresponding central axes. The particular acute angle between the first and second elongate rods 40, 42 is therefore changeable within any desired range. Furthermore, the articulation of the alignment portion 16 at the first rotating joint 44 enables easy manual adjustment of the relative location of the gripping portion 12 and the arm positioning portion 14, which is useful when different types of users want to be trained using the sports swing trainer 10 of this embodiment.

The arm positioning portion 14 is connected to the second elongate rod 42 of the alignment portion 16 at an opposite terminal end from where the second elongate rod 42 engages the first elongate rod 40. As introduced above, the arm positioning portion 14 and the alignment portion 16 are joined at a second telescoping joint 56, which has similar structure and functionality as the first telescoping joint 22 joining the gripping portion 12 to the alignment portion 16. The arm positioning portion 14 includes a harness member 58, which is configured to engage with a top portion of the user's shoulder as well as engage with a brachium of the same arm of the user, and an elongate receptacle 60 extending generally upwardly from the harness member 58. The elongate receptacle 60 is hollow at least at a terminal end thereof so as to be able to receive the second elongate rod 42 therein. Just like the hollow receptacle 30 on the gripping portion 12, the elongate receptacle 60 is sized slightly larger than the second elongate rod 42 so that the second elongate rod 42 can be slidingly received in and frictionally clamped in position by the elongate receptacle 60. The elongate receptacle 60 is shown as a generally cylindrical member along the entire length thereof, but it will be understood that the shape and profile of this element may be modified without departing from the scope of this disclosure in other embodiments.

Also just like the previously-described hollow receptacle 30 on the gripping portion 12, the elongate receptacle 60 defines a split ring at least adjacent the second telescoping joint 56 with a pair of outwardly extending flanges 62 formed on either side of the split. The second telescoping joint 56 further includes a manually-adjustable securing assembly, which in this embodiment takes the form of a threaded bolt 34 and a wing nut 36 threadably engaged with the bolt 34. The bolt 34 extends through apertures (not shown) in the flanges 62 with a head 34*a* of the bolt on one side opposite the side where the wing nut 36 engages the bolt 34. Thus, as the wing nut 36 is tightened on the bolt 34, these elements draw the flanges 62 of the split ring shape of the elongate receptacle 60 closer together to thereby compress the space therein and clamp onto the second elongate rod 42 that is inserted into the elongate receptacle 60. The second telescoping joint 56 is therefore manually tightened to lock these elements in relative position and manually loosened when adjustment is necessary. It will be understood that other types of securing assemblies and fasteners/nuts may be used in other embodiments of the trainer 10 at this second telescoping joint 56.

Figure 4:
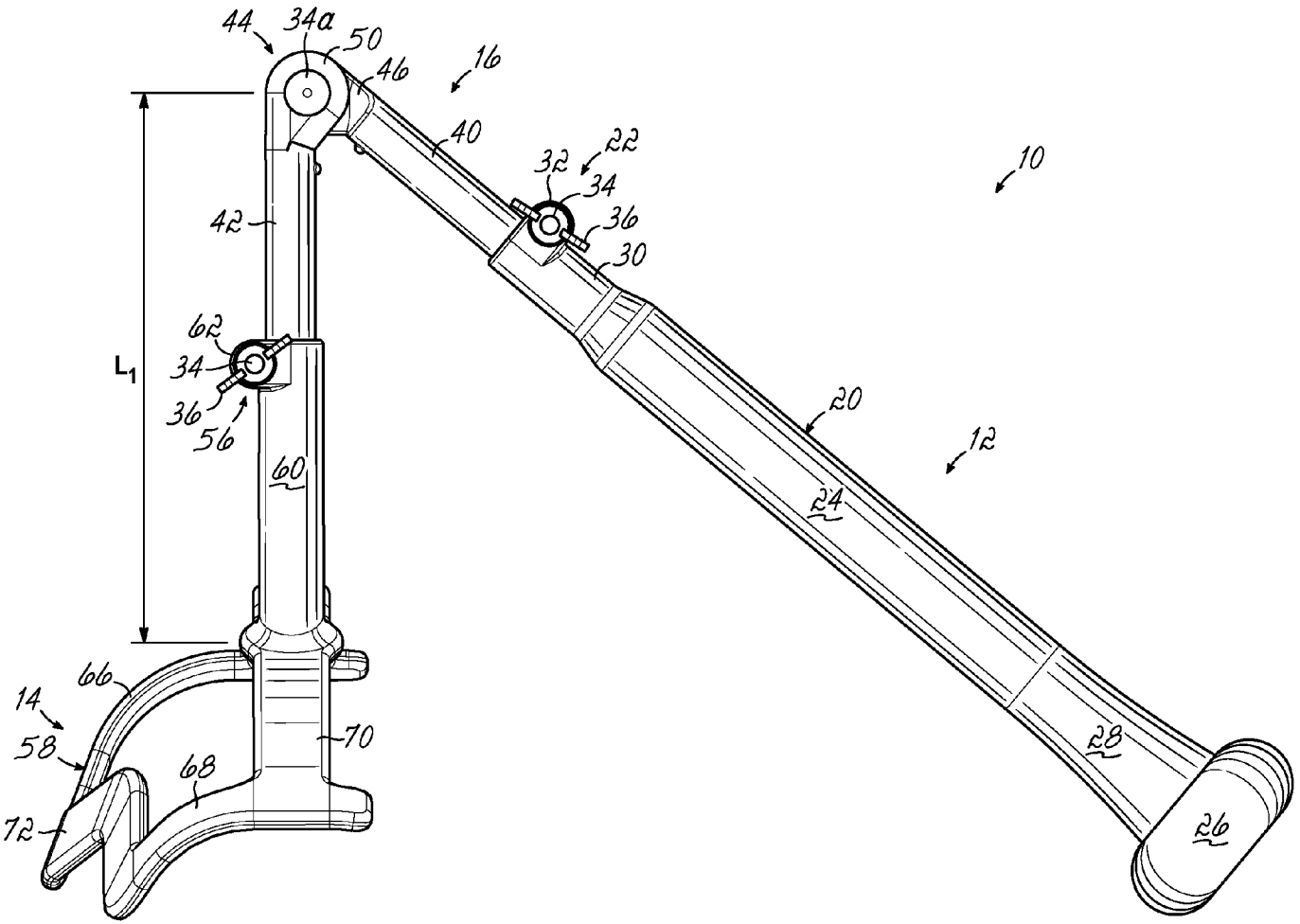
FIG. 4 is a side view of the sports swing trainer of FIG. 1, with a telescoping joint and a rotating joint of the trainer in initial positions.

The operation of the second telescoping joint 56 at the alignment portion 16 is shown most clearly in FIGS. 4 and 5. In FIG. 4, a majority of the second elongate rod 42 is located outside the elongate receptacle 60 such that the harness member 58 is located at a first distance $L_1$ from the first rotating joint 44. In contrast, FIG. 5 illustrates that after loosening at the second telescoping joint 56, the second elongate rod 42 is moved such that much of the length thereof is now inside the elongate receptacle 60, thereby changing the distance between the harness member 58 and the first rotating joint 44 to be a smaller value $L_2$. It will be understood that in this and other telescoping joints throughout this disclosure, the two elements being connected can also be rotated relative to one another about the longitudinal axes of the elements (e.g., for the second telescoping joint 56, the second elongate rod 42 may be rotated as well as moved laterally relative to the elongate receptacle 60 when the second telescoping joint 56 is loosened). The particular distance between the harness member 58 and the first rotating joint 44 is therefore changeable within any desired range. Moreover, the movement of the arm positioning portion 14 at the second telescoping joint 56 enables easy manual adjustment of the relative location of the gripping portion 12 and the arm positioning portion 14, which is useful when different types of users want to be trained using the sports swing trainer 10 of this embodiment.

The harness member 58 of the arm positioning portion 14 is shown from various angles in FIGS. 1 through 4 so as to reveal the generally three-dimensional shape thereof. In this regard, the harness member 58 is formed from a generally flat elongate loop of material, which like the other elements of the trainer 10 may be injection molded of a plastic material such as polypropylene, polyethylene, polyethylene terephthalate, synthetic rubber, and combinations thereof, or alternatively formed from wood, metals such as aluminum, and fiber composite materials. More specifically, the harness member 58 includes a first arcuate strip 66 and a second arcuate strip 68 connected at respective opposing ends with a top side strip 70 and a back side strip 72, these strips collectively defining a loop of material which essentially forms a rectangular-like shape when viewed in perspective. The first arcuate strip 66 is curved so as to define a first part of the arm positioning portion 14 which engages the top portion of a shoulder of the user when properly positioned in contact with the user, while the second arcuate strip 68 is curved so as to define a second part of the arm positioning portion 14 which engages the brachium (e.g., upper arm) of the user when properly positioned in contact with the user. The top side strip 70 and the back side strip 72 are straight in portions and curved in portions so as to allow the harness member 58 to wrap around the shoulder of the user when the first and second arcuate strips 66, 68 are positioned as described above on the user. For example, the portion of the top side strip 70 between the first arcuate strip 66 and the connection to the elongate receptacle 60 is arced upwardly so that it wraps around the deltoid muscle of the user. This relative positioning of the harness member 58 and its elements on a user is shown, for example, in the view of FIG. 7. In each of these views, the harness member 58 and user shown are right-handed, but it will be understood that a mirror image of the harness member 58 would be manufactured if the user is left-handed.

The elongate receptacle 60 is connected to and extends upwardly from the top side strip 70 in this embodiment of the trainer 10. As a result, the alignment portion 16 is connected to the arm positioning portion 14 at the location on the harness member 58 closest to where the remainder of trainer 10 needs to be located during use of the trainer 10. In addition, FIGS. 2 and 3 reveal that the elongate receptacle 60 is located generally in a single plane with the alignment portion 16 and with the gripping portion 12 for simplicity. This arrangement avoids excessive additional structures that would add to the manufacturing expense and complexity of the trainer 10. The elongate receptacle 60 is relatively centered along the length of the top side strip 70 such that the elongate receptacle 60 extends from the curvature of a user's shoulder when in use rather than at either terminal end (e.g., first and second arcuate strips 66, 68) of the harness member 58. It will be understood that the particular relative placement of the harness member 58 and the elongate receptacle 60 may be modified in other embodiments as well.

In the exemplary embodiment shown in FIGS. 1 through 7, the back side strip 72 is joined with the first and second arcuate strips 66, 68 at rounded edges so as to form a generally U-shaped appearance for these members collectively. The top side strip 70 joins the opposite ends of the first and second arcuate strips 66, 68 at perpendicular joints with the opposite ends of the first and second strips 66, 68 extending partially beyond the top side strip 70. However, it will be understood that these square corners or junctions may be formed as rounded corners, and vice versa for the rounded corners at the back side strip 72 in other embodiments of the harness member 58. As long as the harness member 58 is configured to position one part in engaged contact with the top portion of the user's shoulder and another part in engaged contact with the brachium of the user, the arm positioning portion 14 will work for its intended purpose in this disclosure (regardless of the particular structure provided to define that arm positioning portion 14). In one such example, the harness member 58 is replaced by a series of rod-like curved portions and straight portions in other embodiments of the trainer 10 described in further detail below.

Figure 7:
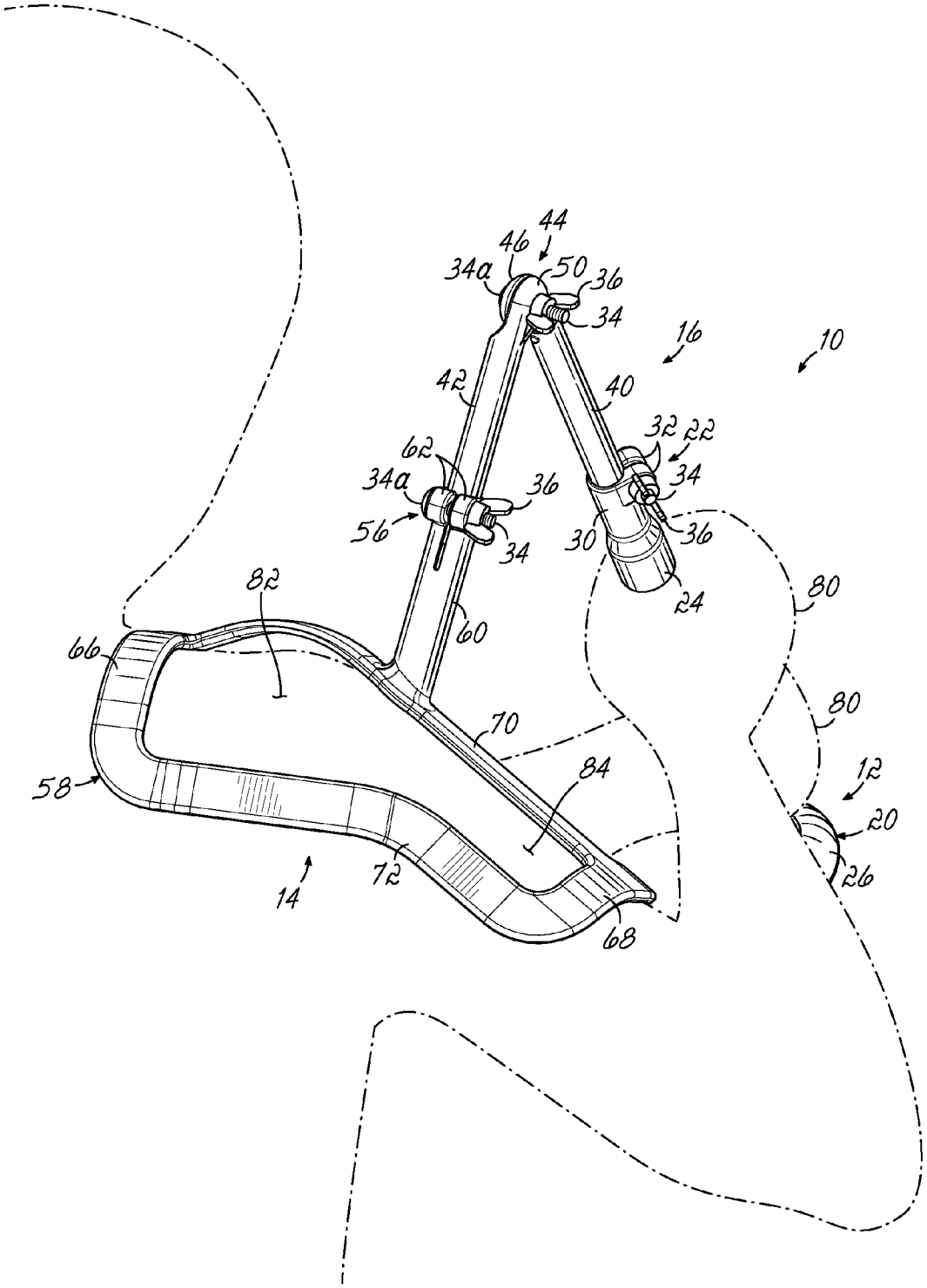
FIG. 7 is a perspective view of the sports swing trainer of FIG. 1 shown in a use position on a user, who is illustrated in phantom.

As initially described above, FIG. 7 illustrates the sports swing trainer 10 in use with a user shown in phantom to help clarify the method of use. As shown in FIG. 7, the user takes a batting stance with the hands 80 grasping the gripping portion 12 along the bat-like handle 20 and the arms rotated back to an initial position taken when preparing to swing a baseball bat (e.g., front arm extended back across front of body and rear arm relaxed and bent at the elbow so that the elbow points generally downwardly and rearwardly from the body). In order to ensure that the arms and body are in this correct initial position, the user should engage the harness member 58 to wrap around the shoulder 82 as shown. More particularly, the first arcuate strip 66 should be held in engagement with a top surface of the shoulder 82, such as along the collarbone between the neck and the shoulder 82, and the second arcuate strip 68 should be held in engagement with an outermost surface of the brachium 84, also known as the upper arm or bicep/tricep located above the elbow. It will also be understood that the remainder of the harness member 58 at the top side strip 70 and at the back side strip 72 may also engage with the corresponding curvature at the top and back of the shoulder as well, but this engagement is not critical. A coach or another user should adjust the various joints 22, 44, 56 during a first use of the trainer 10 so that a proper initial batting stance is provided when in the position shown in FIG. 7, with the hands 80 on the gripping portion 12 and the arm positioning portion 14 engaged with the shoulder 82 and the brachium 84.

After the user takes up the batting stance with arms in the correct initial position as shown in FIG. 7, the user will train the proper swinging motion by rotating the hips (and moving the knees/legs accordingly) from the position shown in FIG. 7 rather than moving the arms from this initial position. For example, the right-handed user shown in FIG. 7 would begin rotating the hips in a counterclockwise direction to begin the swinging motion. The harness member 58 should remain engaged with the top portion of the shoulder 82 and the brachium 84 during this initial part of the swing movement to ensure that the swing is beginning with the hips and legs rather than with arm movements. Once the hips begin moving, the body and arms will be torque driven to follow with an impactful, proper swing of the bat, and of course, the harness member 58 can then be released from contact with the shoulder 82 and the brachium 84 to follow through with the full arm movement of the swing. This corrected or proper baseball bat swing that starts with hip movement will enable maximum force and impact to be delivered when contact is made with a ball by the baseball bat.

In a specific training method or regimen, this initial movement of the hips and legs instead of the arms can be trained into muscle memory by performing numerous repetitions of the hip rotation (while keeping the arm positioning portion 14 in engagement with the top portion of the shoulder 82 and the brachium 84 during the initial part of the hip rotation). For a right-handed user, this could involve performing ten counterclockwise rotations of the hips followed by a rest period, and then ten more counterclockwise rotations of the hips, and so on. For a left-handed user, everything remains the same except for the use of clockwise rotations of the hips. This repeated movement will train the muscles over time to naturally swing in a powerful and impactful manner, which only happens when the swing is initially generated with hip movements rather than with arm movements. By forcing a user to place the harness member 58 into engagement with both the top portion of the shoulder 82 and with the brachium 84 during the initial batting stance and during the initial hip movement of the swing, tactile feedback is immediately provided to the user to identify and correct bad habits that may form in the batting stance or swing motion, including the use of improper arm position in the batting stance and improper starting of swings with arm motion rather than hip movement. In this regard, the sports swing trainer 10 is easy to use both during initial training of young baseball players as well as remedial training for older baseball players, and the training method is a straightforward way to correct most errors and bad habits that users will typically develop in the baseball bat swinging motion.

Advantageously, the trainer 10 is also easy to adjust when a new user needs to be trained with the device. A coach or manager simply has to manually loosen the bolts 34 and wing nuts 36 and adjust the relative positions of the gripping portion 12 and alignment portion 16 to suit the proper batting stance of the new user. Furthermore, because the wing nuts 36 are easily tightened with a single hand, the user himself may also adjust and lock the trainer 10 in a proper position while positioning the trainer 10 as shown in FIG. 7. The trainer 10 is also easily manufactured from a minimum number of components, which reduces the cost to the consumer and also reduces the likelihood of product maintenance being required. Thus, the sports swing trainer 10 provides many benefits to users who want to learn or fix errors when swinging a baseball bat, and the trainer 10 will be economically accessible to all types of players or users.

Figure 8:
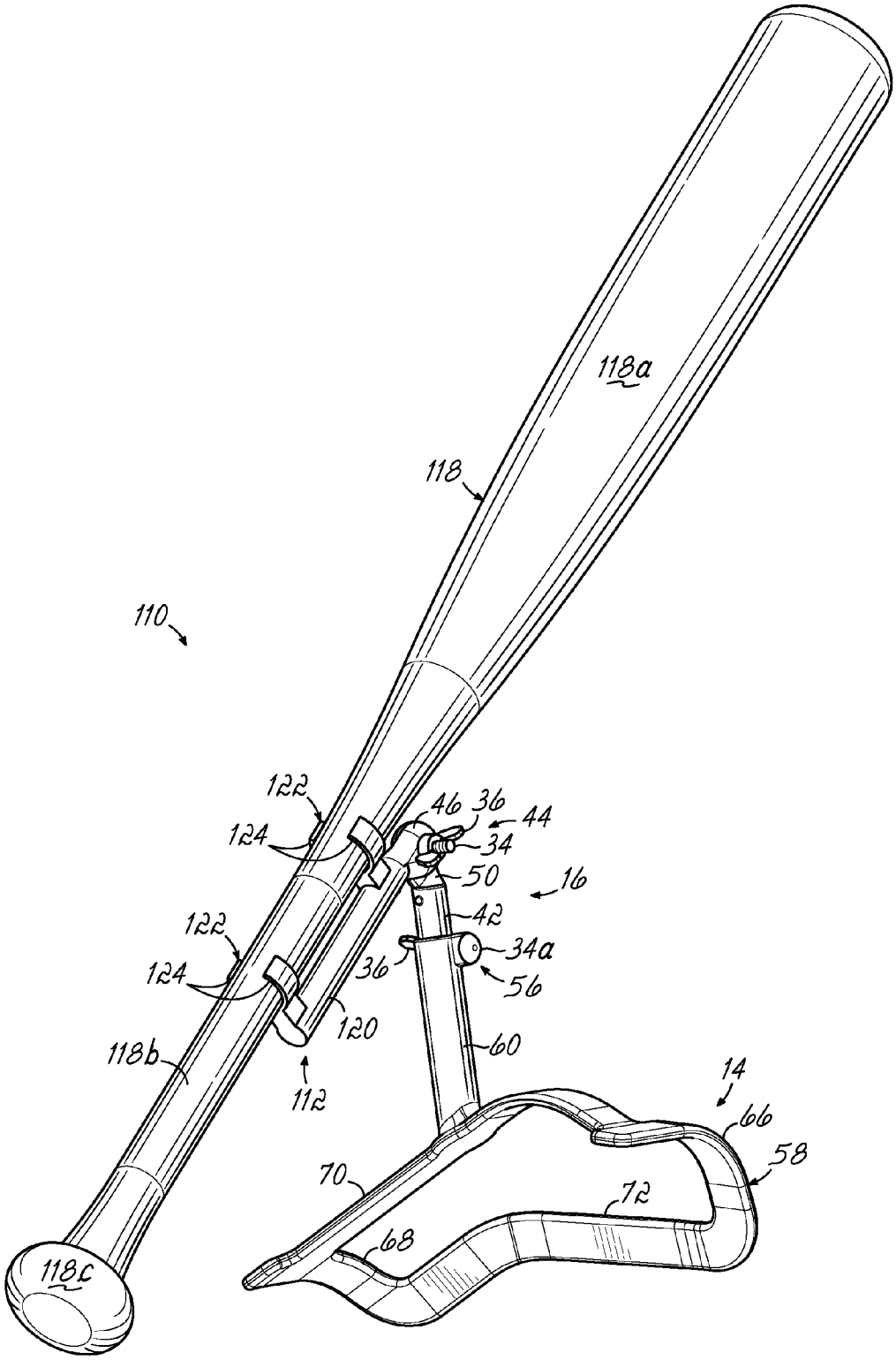
FIG. 8 is a rear perspective view of a sports swing trainer in accordance with another exemplary embodiment, this embodiment of the trainer including a different gripping portion configured to snap onto a conventional baseball bat.
Figure 9:
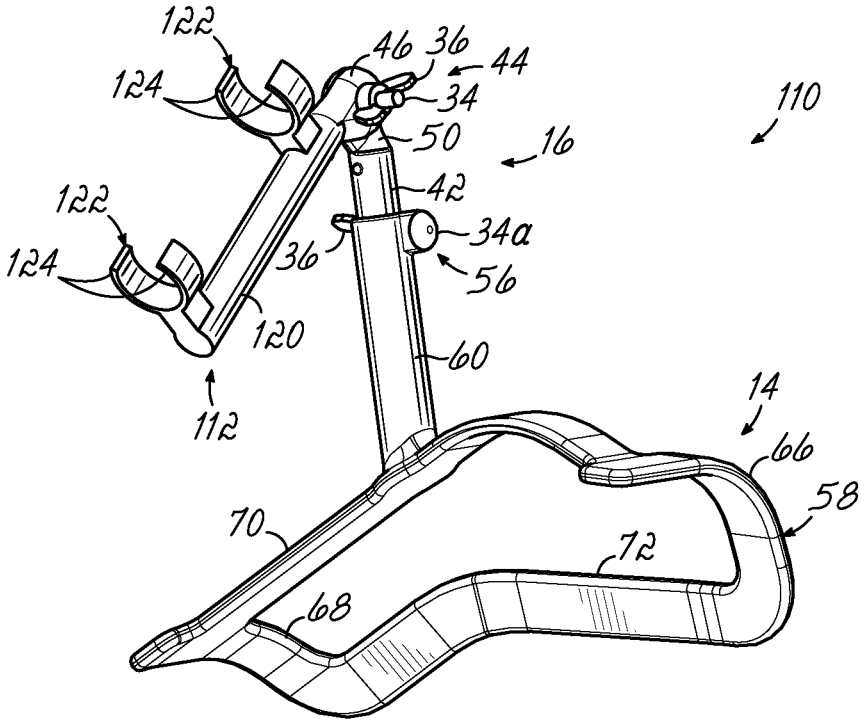
FIG. 9 is a rear perspective view of the sports swing trainer of FIG. 8 with the baseball bat removed to show additional features of the gripping portion.
Figure 10:
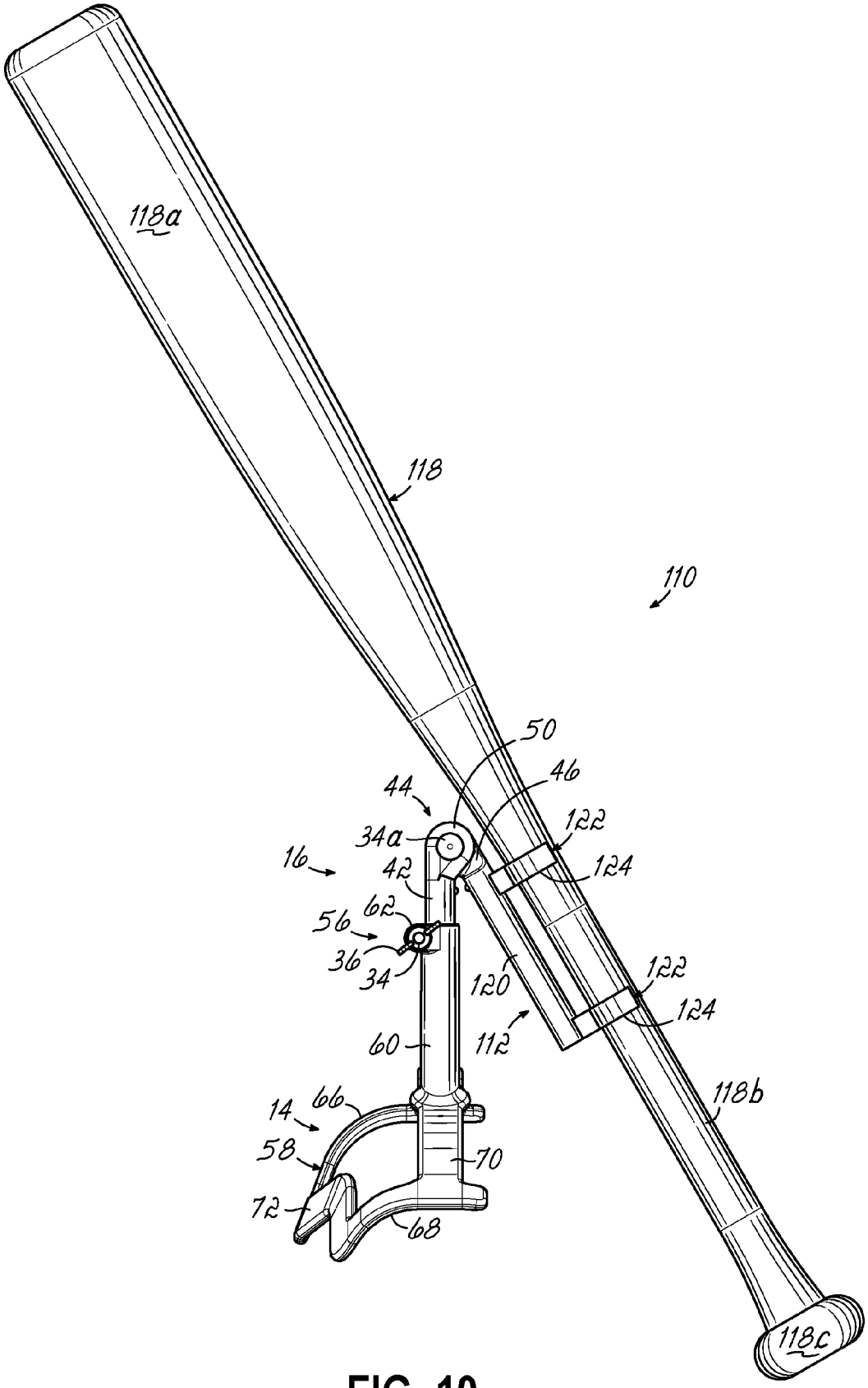
FIG. 10 is a side view of the sports swing trainer of FIG. 8.

With reference to FIGS. 8 through 10, a second exemplary embodiment of a sports swing trainer 110 is shown in detail. The trainer 110 of this embodiment includes many of the same identical features as described above in the first embodiment (including, for example, the arm positioning portion 14 with the harness member 58 and the alignment portion 16 with first and second elongate rods 40, 42). These identical or substantially similar elements are provided with the same reference numbers and further detailed description of these elements is not deemed necessary below.

The major difference of this embodiment of the trainer 110 is the use of a modified gripping portion 112, with this gripping portion 112 being configured to snap into frictional engagement with a conventional baseball bat 118. As well understood, the conventional baseball bat includes a barrel 118*a* (where the ball is hit), a narrowed handle 118*b* extending from the barrel 118*a*, and a knob 118*c* at the end of the handle 118*b* opposite the barrel 118*a*. The gripping portion 112 of this embodiment snaps onto the baseball bat 118 at a location generally between the barrel 118*a* and the handle 118*b*. As a result, the user can hold and swing a real baseball bat during methods of training with the trainer 110, which may lead to a more natural transition and muscle memory development for when the trainer 110 is removed from the baseball bat 118 during normal game play.

The modified gripping portion 112 includes a rod-like support member 120 which extends from a terminal end of the elongate rod 40 at the alignment portion 16. It will be understood that the elongate rod 40 may be connected to the support member 120 with an adjustable first telescoping joint as described in detail above, or alternatively, the elongate rod 40 may be shortened as shown in the drawings and directly coupled or integrally formed with the support member 120 instead of being adjustable/telescoping. Likewise, the gripping portion 112 and its support member 120 may be injection molded of a plastic material such as polypropylene, polyethylene, polyethylene terephthalate, synthetic rubber, and combinations thereof, or alternatively formed from wood, metals such as aluminum, and fiber composite materials. The support member 120 is sufficiently elongate to support two retention clip devices 122, such as at opposing ends of the support member 120. The retention clip devices 122 are configured to snap into engagement with the baseball bat 118 to hold the bat 118 in position relative to the remainder of the trainer 110 via frictional engagement.

The retention clip devices 122 of this embodiment are each defined by a pair of opposed naturally-resilient spring arms 124 which encircle a substantial portion of the periphery of the baseball bat 118 when engaged at a location along the baseball bat 118. The spring arms 124 are therefore sized so that a successful snap engagement and frictional lock on various types and sizes of baseball bats 118 can be generated by the trainer 110. It will be appreciated that other types of retention devices or clip devices can be used to secure the baseball bat 118 in position on the gripping portion 112 of the trainer 110 in other embodiments consistent with the scope of this disclosure (for example, clamping devices or wrap-around loops could also be used in place of the retention clip devices 122 if more secure attachment to the baseball bat 118 is needed). It will also be understood that more or fewer of the retention clip devices 122 may be provided on the gripping portion 112 in other embodiments. The advantageous simple method of use and adjustment for training the batting stance and initial swinging motion is identical in this embodiment of the trainer 110 as that described above (and therefore that description is not repeated here), but for the placement of the user's hands 80 on the handle 118*b* of the baseball bat 118 rather than on a bat-like handle.

Now turning with reference to FIGS. 11 through 15, a third exemplary embodiment of a sports swing trainer 210 is shown for teaching a user how to properly swing a baseball bat. Similar to the previous embodiments, this trainer 210 includes a gripping portion 212 configured to be grasped by the hands 80 of a user, an arm positioning portion 214 that simultaneously engages a top portion of the shoulder 82 of the user as well as a brachium 84 of the user (the specific placement will be described with connection to the drawing showing the use of this trainer 210 in FIG. 15 below), and an alignment portion 216 which connects the gripping portion 212 and the arm positioning portion 214. However, each of these elements has been modified in some manner from previous embodiments. To this end, the gripping portion 212 simulates a portion of a baseball bat in a similar manner as the gripping portion 12 of the first embodiment, but the method of connection to the arm positioning portion 214 is modified. Moreover, the arm positioning portion 214 and at least a part of the alignment portion 216 are collectively defined by a unitary rod member having a series of straight portions and curved portions as set forth in detail below.

Beginning with the gripping portion 212, this element includes a bat-like handle 20 that is connected to the alignment portion 216 at a threaded clamp assembly 220. However, with the exception of this distinctive coupling to the alignment portion 216, the bat-like handle 20 is substantially the same as that described in connection with the first embodiment above. Thus, this bat-like handle 20 and its associated elements (including the elongated handle shaft 24, the enlarged knob 26 at a terminal end away from the connection to the alignment portion 216, and the tapered portion 28) are provided with the same reference numbers in this embodiment without further explanation being necessary below.

Figure 11:
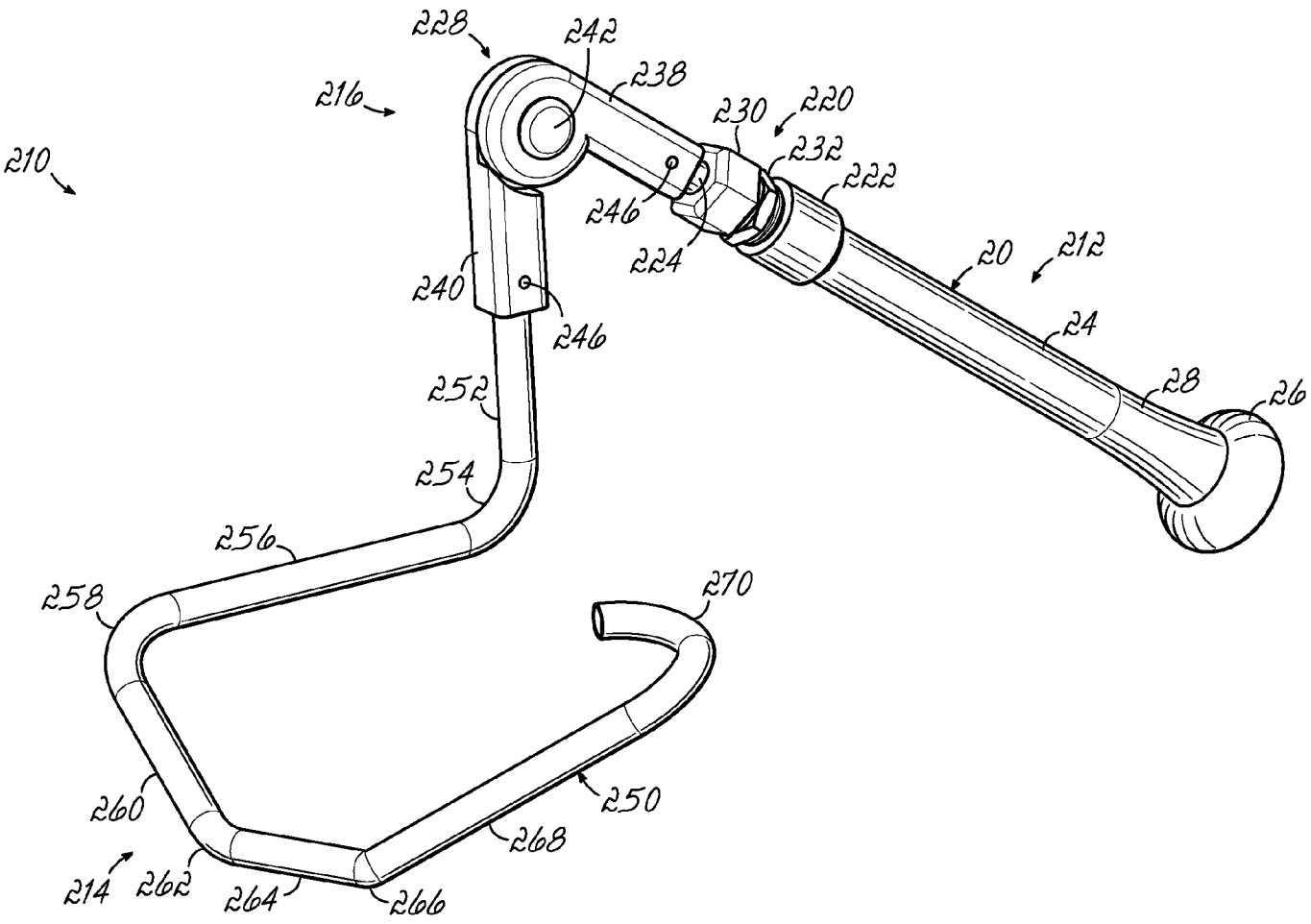
FIG. 11 is an isometric view of a sports swing trainer in accordance with a further exemplary embodiment, this embodiment of the trainer including a different unitary rod member to define a part of the alignment portion and the entire arm positioning portion.
Figure 12:
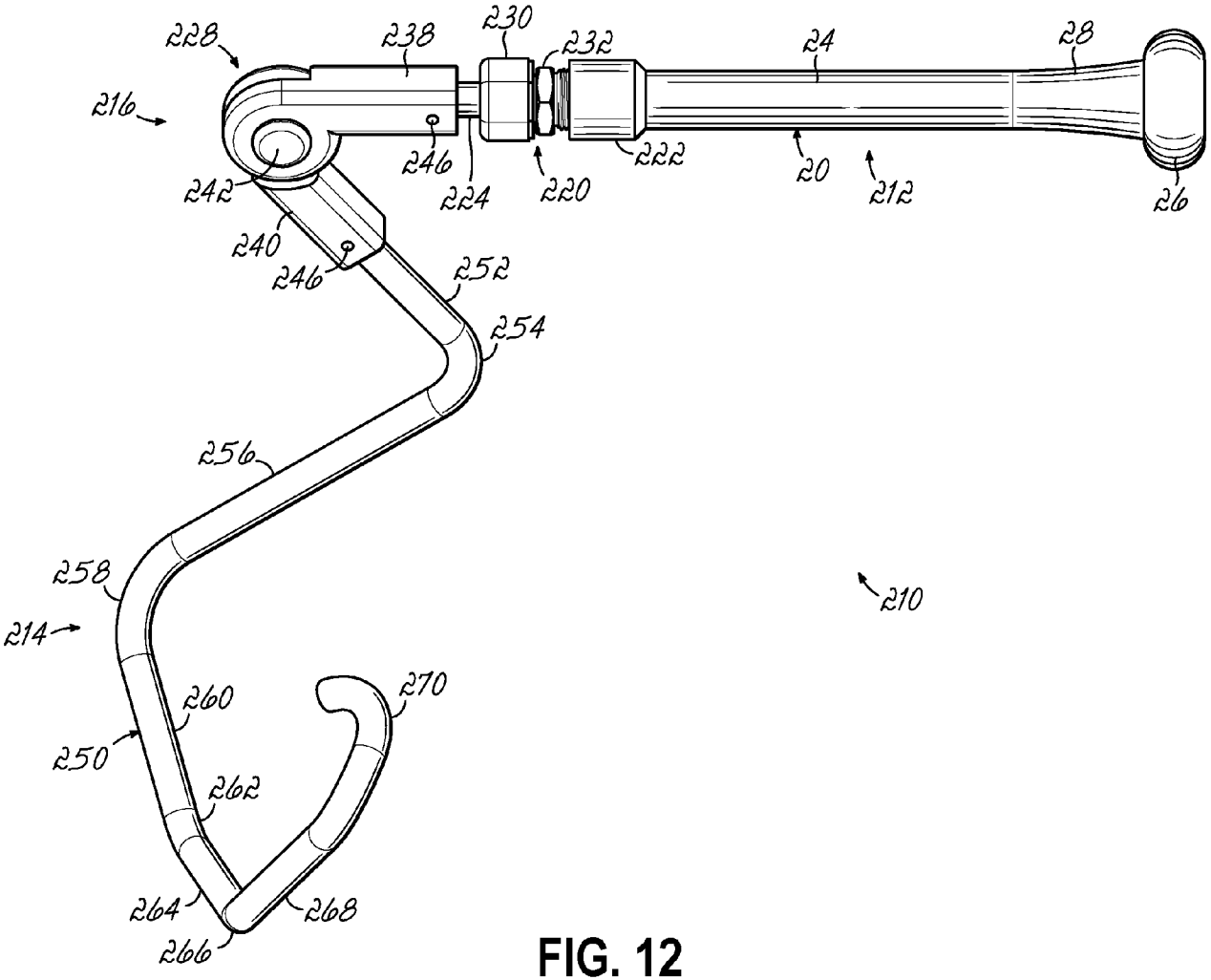
FIG. 12 is a front view of the sports swing trainer of FIG. 11.
Figure 13:
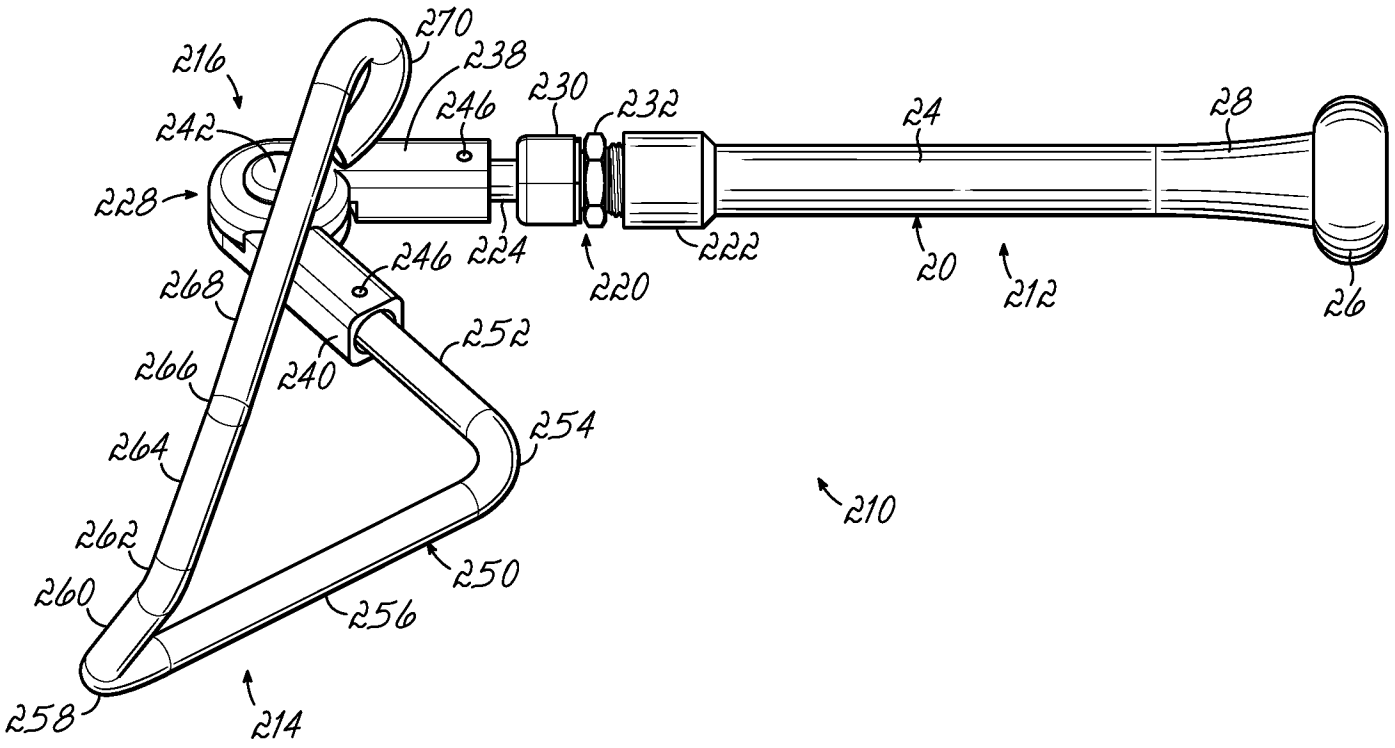
FIG. 13 is a top view of the sports swing trainer of FIG. 11.
Figure 14:
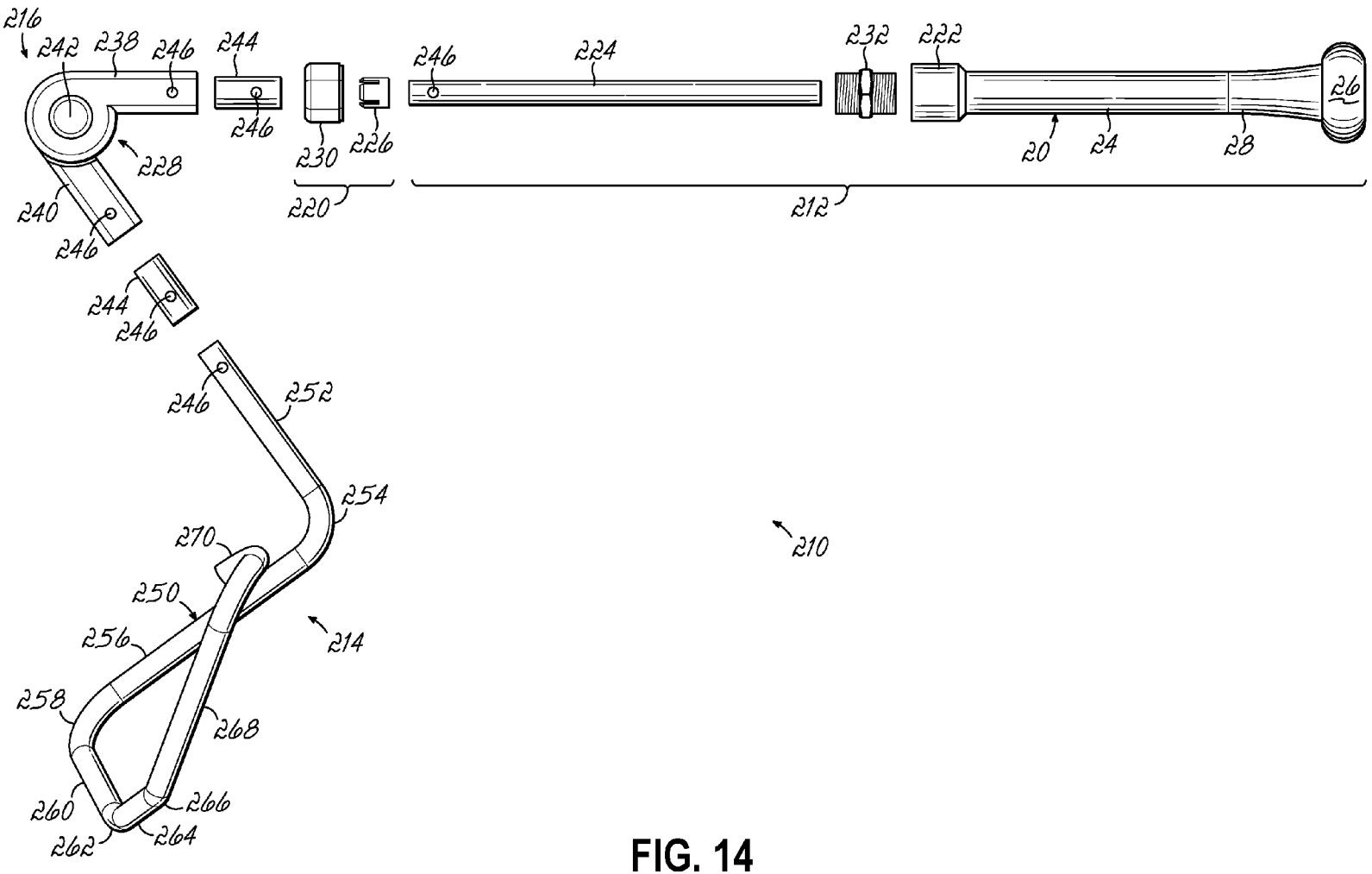
FIG. 14 is an exploded view of the sports swing trainer of FIG. 11, thereby showing the various elements assembled to form the trainer.

The gripping portion 212 is shown assembled to the alignment portion 216 in FIGS. 11 through 13, but these elements forming these portions 212, 216 are exploded apart for clarity in FIG. 14. For example, the gripping portion 212 is hollow along a substantial majority of the length thereof, and an enlarged receptacle 222 is provided at an end of the bat-like handle 20 opposite the knob 26. The enlarged receptacle 222 is sized to receive both a connection rod 224 included in the alignment portion 216 and (optionally) a deflectable lock member 226 included in the clamp assembly 220. Of course, it will be understood that the connection rod 224 may alternatively be considered part of the handle or gripping portion 212 without departing from the scope of the current disclosure (in this case, the connection between the gripping portion 212 and the alignment portion 216 would be at a ratcheting joint 228 included in the alignment portion 216.

The clamp assembly 220 acts as an end cap for the gripping portion 212 and therefore it includes the deflectable lock member 226 (also referred to as a collet), a closure cap 230, and (optionally as shown in this embodiment) a threaded adapter 232. As will be described in further detail below, the connection rod 224 is coupled to the ratcheting joint 228 along one end and the other end is inserted into the enlarged receptacle 222 and bat-like handle 20. The lock member 226 is slid onto the connection rod 224 between the two opposing ends, specifically at the location where it is desired to position the connection rod 224 adjacent the enlarged receptacle 222. In this embodiment, the enlarged receptacle 222 and the closure cap 230 are each internally threaded, so the threaded adapter 232 visible in FIGS. 11 through 13 is engaged with the threading on one end to the enlarged receptacle 222. The outermost smooth contoured portion of the closure cap 230 has a generally hexagonal peripheral shape. As the closure cap 230 is tightened by manual rotation into threaded engagement with the other end of the threaded adapter 232, which will force the lock member 226 positioned within the adapter 232 and/or the closure cap 230 to deflect into a clamped frictional engagement with the connection rod 224. More specifically, the lock member 226 may be squeezed between tapered internal surfaces in the closure cap 230 and in the enlarged receptacle 222 to force the deflection of the lock member 226 that clamps these elements in place relative to one another. This clamped frictional engagement holds the connection rod 224 in position adjacent the enlarged receptacle 222 until the closure cap 230 is unthreaded from the engagement described above. Several alternative versions of the clamp assembly 220 are possible, including removing the threaded adapter 232 and instead providing external threading on the enlarged receptacle 222 for the closure cap 230 to engage with, or having the adapter 232 engage with the lock member 226 during tightening of the closure cap 230 to force the lock member 226 to frictionally engage the enlarged receptacle 222, without departing from the scope of this disclosure. It will also be appreciated that the clamp assembly 220 may be modified or replaced with other similar structures for retaining the connection rod 224 in position relative to the gripping portion 212 in other embodiments. The clamp assembly 220 enables easy adjustment (of the length between the ratcheting joint 228 and the knob 26, while also enabling a quick disassembly of the gripping portion 212 from the remainder of the device when it is desired to change out the bat-like handle 20 or a grip sleeve engaged with that handle 20.

With continued reference to FIGS. 11 through 14, the alignment portion 216 includes the connection rod 224 and the ratcheting joint 228 as previously described. The ratcheting joint 228 is an alternative to the wing nut based rotating joint formed in the first two embodiments described above. More particularly, the ratcheting joint 228 includes a first ratchet receptacle member 238 and a second ratchet receptacle member 240 connected at a pivot point 242 (including some sort of internal ratcheting mechanism that is not shown for retaining the two ratchet receptacle members 238, 240 in different angled positions relative to one another). The ratcheting joint 228 may be formed from plastic, metal, or similar materials, or it could be provided as an off-the-shelf pre-made part added to the trainer 210. The first ratchet receptacle member 238 receives an adapter member 244 and the connection rod 224 therein, each of these elements having corresponding through apertures 246 which may be aligned and pinned together to hold the end of the connection rod 224 within the first ratchet receptacle member 238. It will be understood that the adapter member 244 may be omitted when it is not necessary to adjust the peripheries of the connection rod 224 and the first ratchet receptacle member 238 to match each other. Therefore, when the threaded clamp assembly 220 (or a similar locking device) connects the gripping portion 212 in position relative to the first ratchet receptacle member 238 of the alignment portion 216, this entire part of the trainer 210 is rigidly connected in a linear relationship between the pivot point 242 and the knob 26. That arrangement is similar to the elongate rod 40 and bat-like handle 20 of the first disclosed embodiment, for example.

Similarly, the second ratchet receptacle member 240 receives an adapter member 244 and a first straight portion 252 of a unitary rod member 250 therein, each of these elements having corresponding through apertures 246 which may be aligned and pinned together to hold the end of the unitary rod member 250 within the second ratchet receptacle member 240. It will be understood that the adapter member 244 may be omitted when it is not necessary to adjust the peripheries of the unitary rod member 250 and the second ratchet receptacle member 240 to match each other. The unitary rod member 250 defines a part of the alignment portion 216 as well as an entirety of the arm positioning portion 214 in this embodiment, so the ratcheting movement enabled by the ratcheting joint 228 provides relative movement of the gripping portion 212 and the arm positioning portion 214. When combined with the length adjustability described with reference to the threaded clamp assembly 220 above, the trainer 210 is easily adjustable for different users having different body proportions, just as described in connection with the previous embodiments of the trainer. Furthermore, the trainer 210 of this embodiment is easily manufactured by pinning together (or otherwise coupling) the unitary rod member 250 and the connection rod 224 with the first and second ratchet receptacle members 238, 240 and then locking the gripping portion 212 onto the connection rod 224 by tightening the threaded clamp assembly 220.

As initially described above, the remainder of the trainer 210 located distally from the ratcheting joint 228 is defined by the unitary rod member 250, which includes a series of straight portions and curved portions. In the example shown in this embodiment, the unitary rod member 250 includes the first straight portion 252 and a first curved portion 254 extending from an end of the first straight portion 252 opposite the ratcheting joint 228. The first straight portion 252 and the first curved portion 254 collectively define the distal end of the alignment portion 216 in this embodiment, as all other straight and curved portions described below are considered to be part of the arm positioning portion 214. However, it will be understood that other embodiments may include a unitary rod member 250 with more or fewer segments/portions assigned to the alignment portion 216 and the arm positioning portion 214 without departing from the scope of this disclosure. Furthermore, the first curved portion 254 sweeps through about a 90 degree angle in this embodiment, but this angle could be modified in other embodiments (such as by ±10 degrees, for example). The entire trainer 210 between the first curved portion 254 and the knob 26 on the bat-like handle 20 is disposed within a plane to simplify positioning of the trainer 210 onto the shoulder region during use of the trainer 210, as briefly discussed relative to FIG. 15 below.

Returning to the unitary rod member 250, in this embodiment the portion of this element which defines the arm positioning portion 214 includes, in series: a second straight portion 256, a second curved portion 258, a third straight portion 260, a third curved portion 262, a fourth straight portion 264, a fourth curved portion 266, a fifth straight portion 268, and a curved hook 270 defining a terminal end of the unitary rod member 250 opposite the ratcheting joint 228. The curved hook 270 is the second part of the arm positioning portion 214 that is configured to engage with the user's brachium 84 or upper arm during use. Each of these portions of the unitary rod member 250 may be formed with different lengths and swept angles depending on the particular embodiment, and one particular example is shown in the Figures and generally described below.

To this end, the second straight portion 256 is one of the longer, if not the longest, straight portion in the arm positioning portion 214 because this second straight portion 256 is the part of the arm positioning portion 214 that must run over and engage with the top portion of a user's shoulder 82 when the trainer 210 is in use. The fifth straight portion 268 is also close to as long as the second straight portion 256 because this fifth straight portion 268 must extend from where the unitary rod member 250 wraps around a back of the user to the location where the curved hook 270 needs to be located, which is in contacting engagement with the brachium 84 of the user when the trainer 210 is in use. The third and fourth straight portions 260, 264 are shorter in length so that the wrap around portion of the unitary rod member 250 does not project a long distance out from the back of a user (doing so would necessitate more material usage and more expensive and/or complex manufacturing). In the illustrated embodiment, the second curved portion 258 sweeps through an angle that is about 90 degrees, while the third and fourth curved portions 262, 266 sweep through larger obtuse angles. As most clearly shown in FIG. 14, these three curved portions collectively turn the unitary rod member 250 by more than 360 degrees such that the curved hook 270 can approach inwardly into engaged contact with the brachium 84 when the second straight portion 256 engages with the top portion of the shoulder 82 on the user. Of course, this more than 360 degree turn does not happen in a single plane but instead is an overall three-dimensional curvature that enables wrapping around the shoulder and back of a user in somewhat of a similar manner as the harness member 58 of the earlier-described embodiments. As will be readily understood, the unitary rod member 250 of this embodiment may be injection molded of a plastic material such as polypropylene, polyethylene, polyethylene terephthalate, synthetic rubber, and combinations thereof, although this element may also be formed from wood, metals such as aluminum, and fiber composite materials in other embodiments within the scope of this disclosure.

Figure 15:
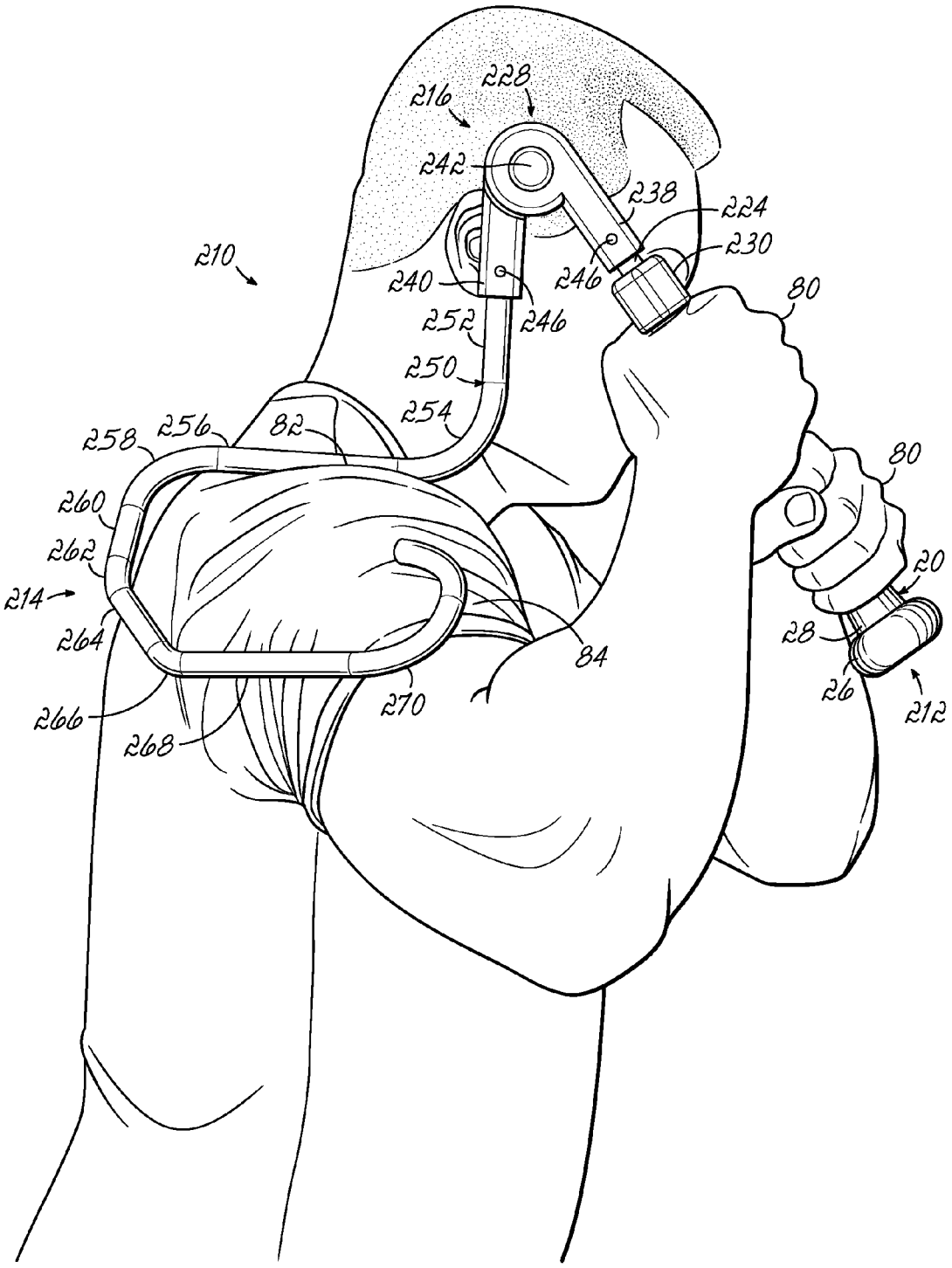
FIG. 15 is a side view of the sports swing trainer of FIG. 11 in use on a user, who is illustrated in solid.
Figure 16:
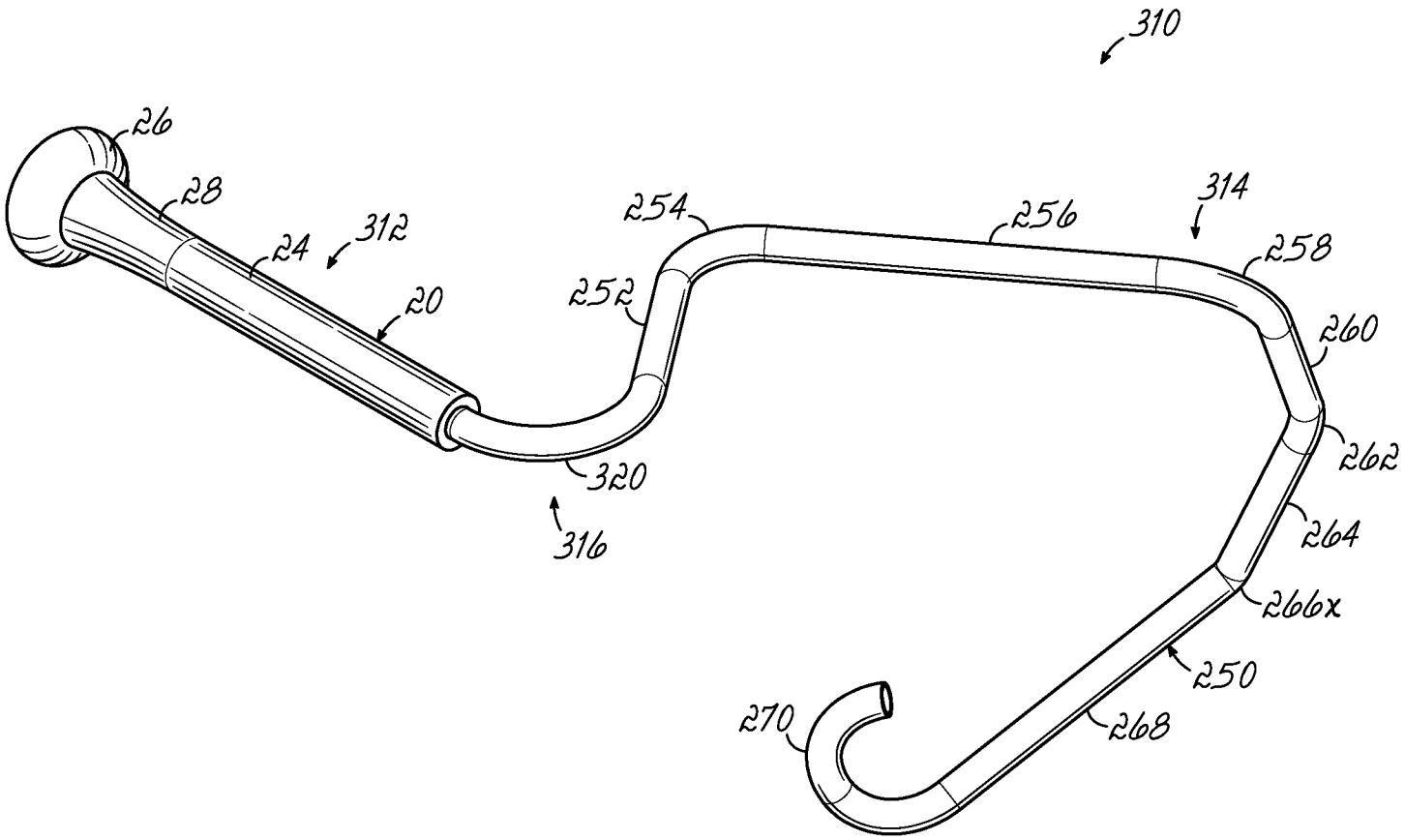
FIG. 16 is an isometric view of yet another exemplary embodiment of the sports swing trainer, this embodiment of the trainer including a unitary rod member defining an arm positioning portion and an alignment portion with no separate ratcheting joint.
Figure 17:
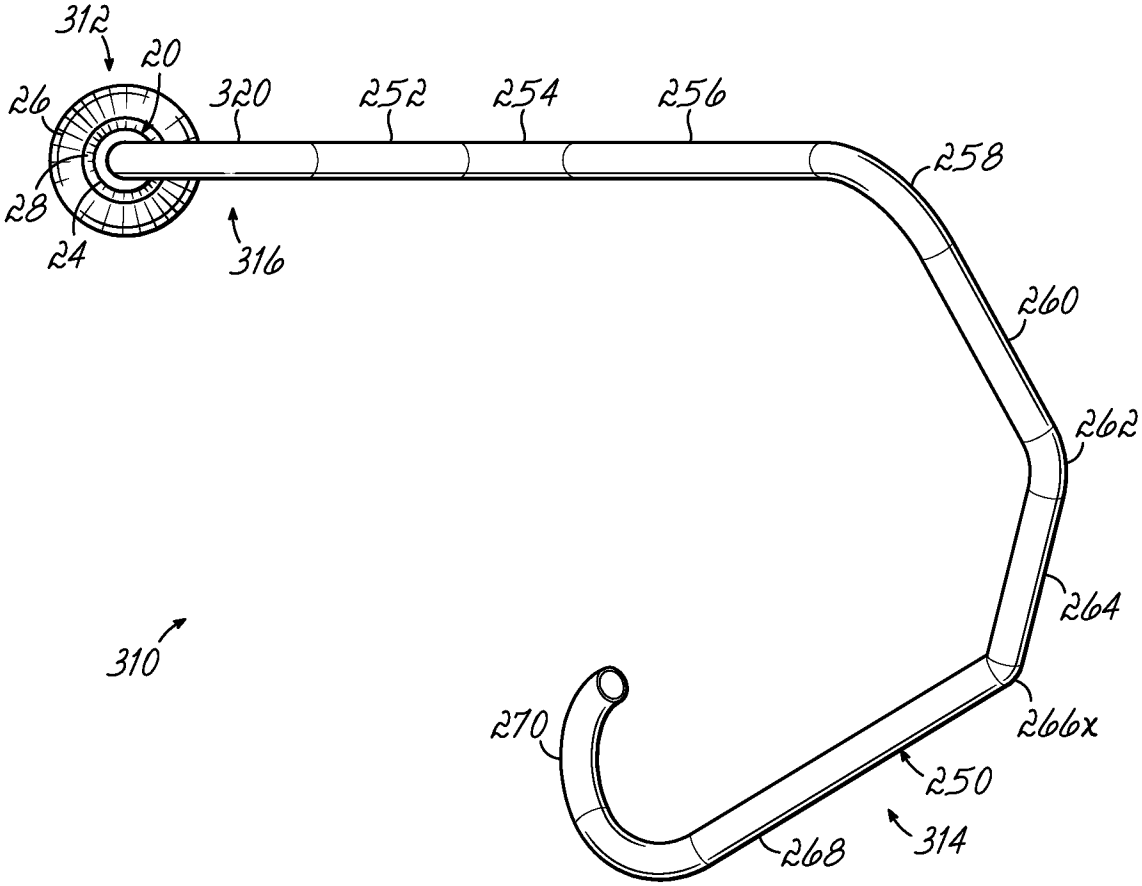
FIG. 17 is a front view of the sports swing trainer of FIG. 16.

Once the trainer 210 of this embodiment is completely assembled, it may be used to train a user on how to set up in a proper batting stance and initial swing movement, in a similar manner as the first two embodiments. As shown in FIG. 15, the user takes a batting stance with the hands 80 grasping the gripping portion 212 along the bat-like handle 20 and the arms rotated back to an initial position taken when preparing to swing a baseball bat (e.g., front arm extended back across front of body and rear arm relaxed and bent at the elbow so that the elbow points generally downwardly and rearwardly from the body). In order to ensure that the arms and body are in this correct initial position, the user should engage the arm positioning portion 214 to wrap around the shoulder 82 as shown. More particularly, the second straight portion 256 of the unitary rod member 250 should be held in engagement with a top surface of the shoulder 82, such as along the collarbone between the neck and the shoulder 82, and the curved hook 270 should be held in engagement with an outermost surface of the brachium 84, also known as the upper arm or bicep/tricep located above the elbow.

After the user takes up the batting stance with arms in the correct initial position as shown in FIG. 15, the user will train the proper swinging motion by rotating the hips (and moving the knees/legs accordingly) from the position shown in FIG. 15 rather than moving the arms from this initial position. For example, the right-handed user shown in FIG. 15 would begin rotating the hips in a counterclockwise direction to begin the swinging motion. The second straight portion 256 and the curved hook 270 should remain respectively engaged with the top portion of the shoulder 82 and the brachium 84 during this initial part of the swing movement to ensure that the swing is beginning with the hips and legs rather than with arm movements. Once the hips begin moving, the body and arms will be torque driven to follow with an impactful, proper swing of the bat. This corrected or proper baseball bat swing that starts with hip movement will enable maximum force and impact to be delivered when contact is made with a ball by the baseball bat. Consequently, this embodiment of the trainer 210 also provides a simple and inexpensive manufacturing process, an easy adjustment process when the trainer 210 is used with different players or users, and a reliable method for training a user on proper batting stance and swing movements.

With reference to FIGS. 16 through 19, yet another exemplary embodiment of a trainer 310 in accordance with the current disclosure is shown in detail. This embodiment of the trainer 310 is similar in many ways to the trainer 210 of the previously described embodiment, including, for example, the provision of a unitary rod member 250 having a series of straight and curved portions leading to a curved hook 270 at a distal end thereof. The trainer 310 also includes a bat-like handle 20 similar to two of the embodiments above. In these aspects, where structural elements have been repeated without significant alteration or change, the same reference numbers have been used in these Figures without further detailed explanation below. The trainer 310 of this embodiment provides the same advantageous manufacturing and method of use features as the previous embodiments, and a brief description follows to highlight the differences in this embodiment of the trainer 310. To this end, the sports swing trainer 310 once again includes a gripping portion 312 configured to be grasped by the hands 80 of a user, an arm positioning portion 314 that simultaneously engages a top portion of the shoulder 82 of the user as well as a brachium 84 of the user, and an alignment portion 316 which connects the gripping portion 312 and the arm positioning portion 314.

The gripping portion 312 of the trainer 310 has a knob 26 on a bat-like handle 20, the bat-like handle 20 also including a tapered portion 28 and a handle shaft 24. In this embodiment, the handle 20 is fixedly connected to the unitary rod member 250 (such as by fastening means similar to those described above which enable telescoping movement and/or rotation of the handle 20 about its central axis), which in this embodiment defines all of the arm positioning portion 314 as well as all of the alignment portion 316. The unitary rod member 250 begins with an alignment curved portion 320 which connects a first straight portion 252 with the handle 20. To this end, the alignment curved portion 320 effectively replaces the ratcheting joint 228 used with the previously-described embodiment. The unitary rod member also includes the first straight portion 252 and a first curved portion 254 connected to the first straight portion 252. The combination of the alignment curved portion 320, the first straight portion 252, and the first curved portion 254 collectively define the alignment portion 316 of this embodiment of the trainer 310.

The arm positioning portion 314 defined by the unitary rod member 250 in this embodiment includes the following portions in series. A second straight portion 256 is connected to the first curved portion 254. A second curved portion 258 is connected to the second straight portion 256. A third straight portion 260 is connected to the second curved portion 258. A third curved portion 262 is connected to the third straight portion 260. A fourth straight portion 264 is connected to the third curved portion 262. A fourth curved portion 266*x* is connected to the fourth straight portion 264. A fifth straight portion 268 is connected to the fourth curved portion 266. A curved hook 270 is connected to the fifth straight portion 268.

In this embodiment, the fourth curved portion 266*x* is provided as a joint 266*x*. Depending on the needs of the end user, this joint can be articulating. The connected portions and joint 266*x* form the arm positioning portion 314 of the sports swing trainer 310 of this embodiment. As with the previous embodiment, the second straight portion 256 defines the part of the arm positioning portion 314 that engages a top portion of the shoulder 82 of the user when using this trainer 310 in a batting stance, and the curved hook 270 defines a second part of the arm positioning portion 314 that engages a brachium 84 of the user when using this trainer 310.

Similar to the description provided above, the various portions of the unitary rod member 250 define various lengths and sweep through various types of angles. In one example, the third curved portion 262 sweeps through an obtuse angle that can range from 120 degrees to 150 degrees. The fourth curved portion 266*x* (or "joint") sweeps through an angle that can range from 90 degrees to 130 degrees. The curved hook 270 defines a three-dimensional curvature but sweeps through an angle of over 360 degrees. The alignment curved portion 320 sweeps through an acute angle that can range from 40 degrees to 90 degrees. The first curved portion 254 sweeps through an angle that can range from 80 degrees to 100 degrees. Likewise, the second curved portion 258 in this embodiment sweeps through an angle that can range from 80 degrees to 100 degrees. The straight portions can each have a length from 3 inches to 10 inches, for example. Furthermore, the straight portions can have identical outer diameters to each other and to the curved portions as shown in the exemplary embodiment, although varied diameters is also possible in other embodiments.

Figure 19:
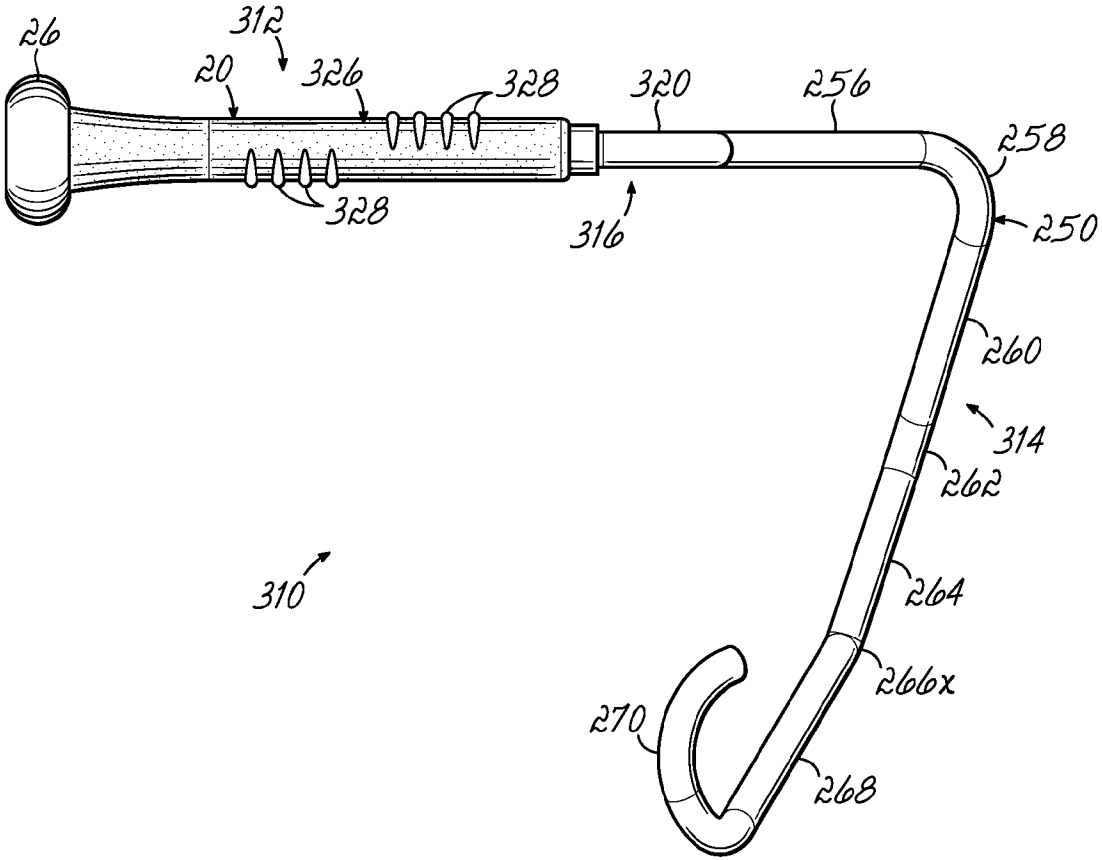
FIG. 19 is a side view of the sports swing trainer of FIG. 18, with a different embodiment of a grip sleeve installed on the handle shaft.

It will be noted that because of the curvatures of the elements and the alignment of some sets of elements in common planes, the view in FIG. 19 obscures visibility of the first straight portion 252 and the first curved portion 254. To this end, one subset of elements contained within a common plane are the handle 20, the alignment curved portion 320, the first straight portion 252, the first curved portion 254, and the second straight portion 256. Another subset of elements in this embodiment that are contained within a different common plane includes third straight portion 260, third curved portion 262, and fourth straight portion 264.

Figure 18:
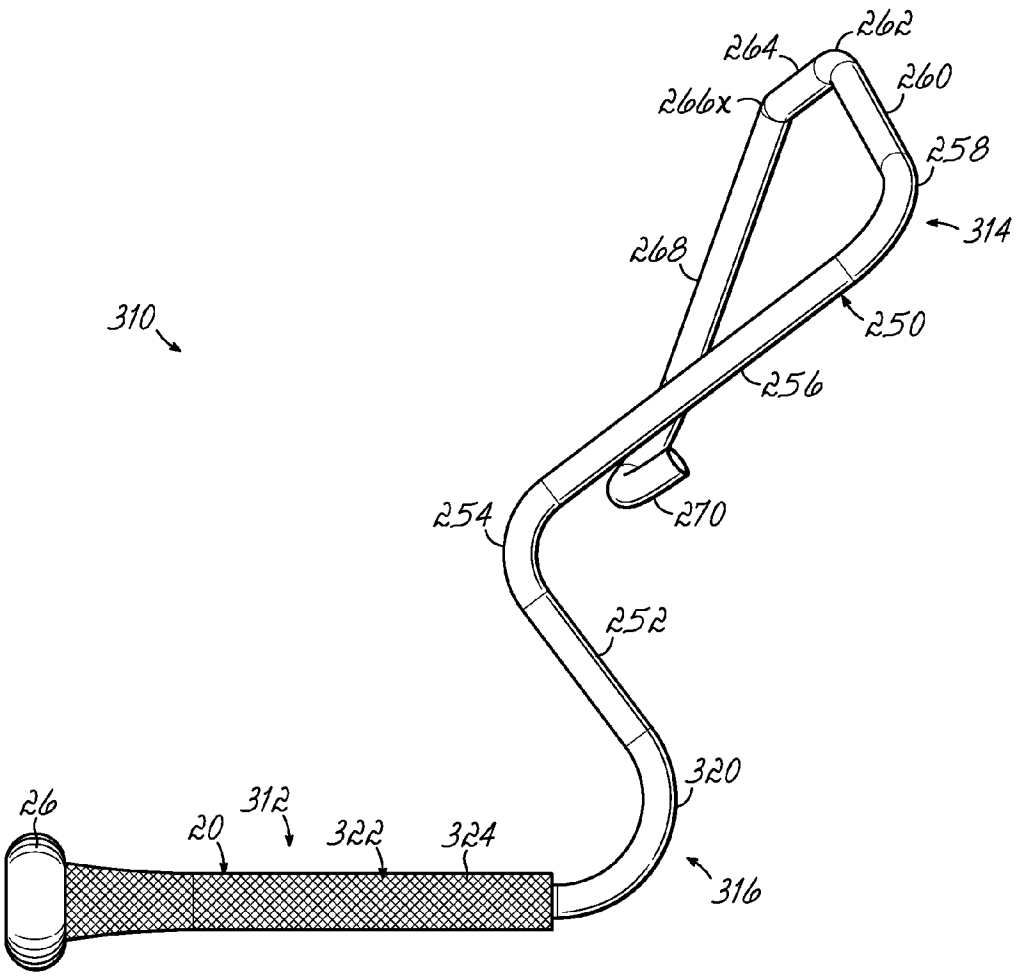
FIG. 18 is a top view of the sports swing trainer of FIG. 16, with a grip sleeve installed on the handle shaft.

As shown in FIG. 18, the gripping portion 312 of this embodiment (and other embodiments as well) may further include a removable grip sleeve 322 typically formed from a rubber material, although this grip sleeve 322 could also be formed from metal, wood, plastics, and/or composites. The grip sleeve 322 includes a pattern 324 formed into the exterior surface thereof such as by embossing, etching, or cutting the sheet used to make the grip sleeve 322. The grip sleeve 322 thereby trains a user to visually inspect and verify a proper grip of the gripping portion 312 with the hands 80. The grip sleeve 322 is removable most easily when the handle 20 is disconnected from the unitary rod member 250, in embodiments that have such a releasable coupling between these elements. In alternative embodiments where the handle 20 is fixedly coupled to the unitary rod member 250, such as by integral formation as one piece or by adhesive gluing of these elements together, the grip sleeve 322 may be removed and replaced by threading it along the unitary rod member 250 until it exits at the curved hook 270. As a result, different grip sleeves 322 can be installed or replaced when necessary with the trainer 310.

An alternative removable grip sleeve 326 is shown in use on the trainer 310 in FIG. 19. This removable grip sleeve 326 includes projecting ridges 328 that can provide alignment of the hands by aligning the fingers. For example, the ridges 328 can be spaced apart at finger widths, which can vary from child finger widths to adult finger widths depending on the size of the sports swing trainer being used. More specifically, the ridges 328 can range from 0.5 inches to 0.75 inches apart in different embodiments for different types of users. The ridges 328 work in a similar manner as a scalloped or profiled handle on a handgun, thereby training the user to grip the gripping portion 312 of the trainer 310 in an appropriate manner when in a batting stance. It will be appreciated that this grip sleeve 326 and other types of grip sleeves can be added to any of the embodiments of the trainer 10, 110, 210 described above as well, and the projecting ridges 328 could alternative be formed permanently in the bat-like handles 20 of those embodiments in other versions.

The sports swing trainer 310 of this embodiment may be used in accordance with the methods above or as follows. A method for training an athlete with the sports swing trainer 310 can involve gripping the handle 20 with both hands by an athlete, positioning the second straight portion 256 on a right or left (e.g., rear) shoulder of the athlete and the curved hook 270 into contact with a brachium of the athlete corresponding to the arm with the rear shoulder, and turning the hips of the athlete to optimize a correct baseball bat swing for maximum impact on a baseball pitched at the athlete, creating muscle memory in the hip muscles and arm muscles of the athlete by minimizing arm motion during an initial part of the swinging motion. To use the sports swing trainer 310, an athlete would grip the handle 20 with two hands. If the athlete is right handed, then the second straight portion 256 of the sports swing trainer 310 would rest on top of the right shoulder of the athlete and simultaneously the curved hook 270 would rest on the outer bicep of the right arm. If the athlete is left handed, then the second straight portion 256 of the sports swing trainer 310 would rest on top of the left shoulder and simultaneously the curved hook 270 would rest on the outer bicep of the left arm. Next, with the sports swing trainer 310 resting on the biceps and shoulders, the athlete turns his or her hips to optimize a correct baseball bat swing for maximum impact on a baseball pitched at the athlete while minimizing arm motion. The trainer 310 encourages turning hips of the athlete to optimize a correct baseball bat swing for maximum impact on a baseball pitched at the athlete creating muscle memory in the hip muscles of the athlete and minimizing arm motion. In this regard, starting a swinging motion by turning the hips before releasing the arms to move produces a natural whip action that increases impact, power, and consistency of a swing. The trainer 310 enables arm movement to be controlled and hip movement to be developed as correct hip motion is the key to an accurate and consistent baseball bat swing. Moreover, the trainer 310 can assist a coach in teaching the importance of good hip placement to improve the chances for impacting a baseball pitched at an athlete, and also teach the proper way to hold a baseball bat and take a batting stance.

In summary, the present embodiments described above provide a durable, impact resistant training device such that even a child could use to learn how to hold a baseball bat properly and swing properly. The trainer creates muscle memory in the hips and arms of amateur athletes in order to improve an athlete's swing of a baseball bat. Training should be repeated enough to create muscle memory in the hips and arms of the athlete.

While the present invention has been illustrated by a description of exemplary embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. A sports swing trainer configured to train a user to properly position and swing a baseball bat during a batting stance, the swing trainer comprising:

a gripping portion configured to be grasped by a user, so as to simulate grasping a handle end of a baseball bat;

an arm positioning portion sized to simultaneously engage a top portion of the user's shoulder and engage the user's brachium, the arm positioning portion including a rigid contoured element having first and second interconnecting parts; and an alignment portion telescopically extending between and connecting the gripping portion to the arm positioning portion, the alignment portion including at least one joint configured to adjust relative positions of the gripping portion and the arm positioning portion, wherein the at least one joint of the alignment portion further comprises at least one telescoping joint operable to extend or retract the gripping portion relative to the arm positioning portion, and at least one rotating joint operable to modify an angle defined between the gripping portion and the arm positioning portion.

wherein when the gripping portion is held by the user and the user assumes the batting stance, the first part of the arm positioning portion engages the top portion of the user's shoulder while the second part of the arm positioning portion engages the user's brachium, thereby providing tactile feedback regarding an appropriate starting position for a swing as well as a tactile reminder to start a swinging motion with hip and leg movement rather than with arm movements.

2. The sports swing trainer according to claim 1, wherein the arm positioning portion further comprises a harness member defined by a series of rigid elongate elements forming a loop, the series of rigid elongate elements including a first arcuate strip that defines a first part of the arm positioning portion that is sized to engage the top portion of the shoulder of the user, a second arcuate strip that is spaced from the first arcuate strip and that defines a second part of the arm positioning portion that is sized to engage the brachium of the user, and side strips connecting the first and second arcuate strips to one another.

3. The sports swing trainer according to claim 1, wherein each of the at least one telescoping joint and each of the at least one rotating joint included in the alignment portion further comprises a threaded fastener and nut that are manually tightened to lock the corresponding joint in position and manually loosened to adjust the corresponding joint.

4. The sports swing trainer according to claim 1, wherein the gripping portion further comprises a retension clip device configured to snap into frictional engagement with a seperate baseball bat that includes a handle end and a barrel end, and wherein the user holds the handle end of the baseball bat with the hands when the baseball bat is engaed with the retention clip device to thereby grasp the trainer.

5. The sports swing trainer according to claim 4, wherein the retention clip device includes at least two pairs of naturally-resilient spring arms which snap into engagement with the separate baseball bat to prevent relative sliding movement of the baseball bat and the gripping poition.

6. The sports swing trainer according to claim 1, wherein the gripping portion further comprises a rigid handle replicating a baseball bat handle and connected to the alignment portion, the bat like rigid handle including an elongated handle shaft and an enlarged knob located at a terminal end of the handle shaft opposite the alignment portion.

7. The sports swing trainer according to claim 6, wherein the gripping portion further comprises a grip sleeve surrounding the handle shaft, the grip sleeve enhancing a user's grasp of the gripping portion with the hands.

8. The sports swing trainer according to claim 7, wherein the grip sleeve includes an exterior surface and a pattern formed in the exterior surface, the pattern configured to train a user to visually inspect and verify a proper grip of the gripping portion with the hands.

9. The sports swing trainer according to claim 7. wherein the grip sleeve includes an exterior surface having outwardly projecting ridges configured to properly align the hands of the user when grasping the gripping portion.

10. The sports swing trainer of claim 1, wherein the arm positioning portion and at least part of the alignment portion are collectively defined by a rigid unitary rod member having a series of straight portions and curved portions, and the arm positioning portion further comprises a rigid straight rod portion at the unitary rod member that defines the first part of the arm positioning portion that is sized to engage the top portion of the shoulder of the user, a rigid curved hook at the unitary rod member that is spaced from the rigid straight rod portion and that defines the second pail of the arm positioning portion that is sized to engage the brachium of the user, and part of the series of straight portions and curved portions connecting the rigid straight rod portion and the rigid curved hook to one another.

11. The sports swing trainer according to claim 10, wherein the gripping portion further comprises a rigid handle replicating a baseball bat handle and connected to the alignment portion, the rigid handle including an elongated handle shaft and an enlarged knob located at a terminal end of the handle shaft opposite the alignment portion.

12. The sports swing trainer according to claim 10, wherein the alignment portion includes a first straight portion connected to the at least one joint and a first curved portion extending from the first straight portion opposite the at least one joint, and wherein the arm positioning portion comprises, in series:

a second straight portion extending from the first curved portion;

a second curved portion extending from the second straight portion opposite the first curved portion;

a further series of alternating straight and curved portions extending from the second curved portion opposite the second straight portion; and the curved hook, which extends from a terminal end of the further series of alternating straight and curved portions opposite the second curved portion, wherein the second straight portion defines the rigid straight rod portion and the first part of the arm positioning portion which engages the top portion of the shoulder of the user.

13. The sports swing trainer according to claim 12, wherein the further series of alternating straight and curved portions consists of a third straight portion connected to the second curved portion, a third curved portion connected to the third straight portion, a fourth straight portion connected to the third curved portion, a fourth curved portion connected to the fourth straight portion, and a fifth straight portion connected to each of the fourth curved portion and the curved hook.

14. The sports swing trainer according to claim 10, wherein the alignment portion includes a first straight portion connected to the at least one joint and a first curved portion extending from the first straight portion opposite the at least one joint, and wherein the joint includes a first receptacle sized to receive and retain the first straight portion relative to a remainder of the alignment portion and the gripping portion.

15. The sports swing trainer according to claim 14, wherein the alignment portion also includes a second receptacle at the at least one joint and a connection rod extending from the second receptacle towards the gripping portion, and wherein the gripping portion is removably connected to the connection rod with a threaded clamp assembly.

* * * * *